US005585320A

United States Patent [19]

Tsutsui et al.

[11] Patent Number: 5,585,320

[45] Date of Patent: Dec. 17, 1996

[54] REVERSIBLE THERMOSENSITIVE COLORING RECORDING METHOD, RECORDING MEDIUM AND RECORDING APPARATUS FOR THE RECORDING METHOD

[75] Inventors: Kyoji Tsutsui, Mishima; Takehito Yamaguchi, Shizuoka-ken, both of Japan

[73] Assignee: Ricoh Company, Ltd., Tokyo, Japan

[21] Appl. No.: 449,746

[22] Filed: May 25, 1995

Related U.S. Application Data

[62] Division of Ser. No. 28,229, Mar. 9, 1993, Pat. No. 5,552,364.

[30] Foreign Application Priority Data

Mar. 9, 1992 [JP] Japan ..... 4-085902
Jun. 25, 1992 [JP] Japan ..... 4-191644

[51] Int. Cl.[6] ..... B41M 5/28; B41M 5/30; B41M 5/40

[52] U.S. Cl. ..... 503/204; 503/201; 503/215; 503/226

[58] Field of Search ..... 427/150–152; 503/201, 204, 226, 215

[56] References Cited

U.S. PATENT DOCUMENTS 4,425,161 1/1984 Shibahashi et al. ..... 106/21

*Primary Examiner*—B. Hamilton Hess
*Attorney, Agent, or Firm*—Oblon, Spivak, McClelland, Maier & Neustadt, P.C.

[57] ABSTRACT

A reversible thermosensitive coloring recording method for producing multi-color images by use of a reversible thermosensitive coloring recording medium which is composed of a support and a reversible thermosensitive coloring recording layer containing a plurality of reversible thermosensitive coloring compositions, each coloring composition being independently present separated from the other coloring compositions, and capable of reversibly forming a color development state with a different color in a predetermined color development temperature range, and a decolorization state in a predetermined decolorization temperature range by the application of heat thereto and maintaining the above two states at room temperature, the decolorization temperature range being located lower in terms of temperature than the color development temperature range therefor, comprises the steps of: temporarily applying heat to the recording medium to a color development temperature at which at least two of the coloring compositions are colored or to a temperature higher than the color development temperature to obtain a mixed coloring state, and decolorizing at least one of the coloring compositions which have been colored, thereby producing multi-color images.

9 Claims, 5 Drawing Sheets

REVERSIBLE THERMOSENSITIVE COLORING RECORDING METHOD, RECORDING MEDIUM AND RECORDING APPARATUS FOR THE RECORDING METHOD

This is a division of application Ser. No. 08/028,229 filed on Mar. 9, 1993, now U.S. Pat. No. 5,582,364.

BACKGROUND OF THE INVENTION

1. Field of the Invention

The present invention relates to a reversible thermosensitive coloring recording method of producing multi-color images by use of a reversible thermosensitive coloring recording medium which is capable of developing and decolorizing a multi-color image repeatedly by utilizing a coloring reaction between an electron-donor coloring compound and an electron-acceptor compound; a method of initializing the reversible thermosensitive coloring recording medium; the reversible thermosensitive coloring recording medium; and a recording apparatus for producing multi-color images by use of, or initializing the reversible thermosensitive coloring recording medium.

2. Discussion of the Background

Conventionally, thermosensitive recording media utilizing a coloring reaction between an electron-donor coloring compound (hereinafter, referred to as a coloring agent) and an electron-acceptor compound (hereinafter, referred to as a color developer) are widely known and have been employed in various fields, for instance, for use with terminal printers for computers, facsimile apparatus, automatic ticket vending apparatus, printers for scientific measuring instruments, and printers for CRT medical measuring instruments. However, such conventional thermosensitive recording media for use with the above-mentioned products do not have reversibility with respect to the coloring or decolorizing in image formation, so that the color development and decolorization cannot be alternately performed repeatedly.

Several thermosensitive recording media which can reversibly develop and decolorize or erase colored images utilizing a coloring reaction between a coloring agent and a color developer have been proposed. For example, a thermosensitive recording medium using the combination of phloroglucinol and gallic acid as color developers is disclosed in Japanese Laid-Open Patent Application 60-193691. Colored images developed by using the gallic acid and phloroglucinol upon the application of heat thereto are erased when coming into contact with water or aqueous vapor. In the case where this type of thermosensitive recording medium is employed, there are difficulties in imparting water-resisting properties to the recording medium and obtaining stable recording preservability. Furthermore, there is another problem in that a large image erasing apparatus is required to erase the displayed image on the above-mentioned recording medium.

Japanese Laid-Open Patent Application 61-237684 discloses a rewritable optical information recording medium which employs a compound such as phenolphthalein, thymolphthalein or bisphenol as a color developer. In the above optical information recording medium, colored images are formed by applying heat thereto and gradually decreasing the temperature thereof. The colored images can be decolorized or erased by applying heat to the recording medium at a temperature higher than the image developing temperature, and then by rapidly cooling the recording medium. In the case of this optical information recording medium, the color developing and decolorizing steps are complicated and the contrast of the colored images is not satisfactory with some undecolorized colors remaining on erased images.

Japanese Laid-Open Patent Applications 62-140881, 62-138568, and 62-138556 disclose thermosensitive recording media using a homogeneously dissolved composition of a coloring agent, a color developer and a carboxylic acid ester. The above recording media can assume a completely colored state at a low temperature, a completely decolorized state at a high temperature, and can maintain the colored state or the decolorized state at a temperature midway between the above-mentioned low temperature and high temperature. When heat is applied to the recording media using a thermal head, a white image (decolorized image), which is similar to a photographic negative, is recorded on a colored background, so that the usage of the above recording media is limited. It is also necessary that the temperature of the recording media be maintained within a specific range in order to preserve recorded images on the recording media.

Japanese Laid-Open Patent Applications 2-188294 and 2-188293 respectively disclose a thermosensitive recording medium utilizing a salt of gallic acid and a higher aliphatic amine, and a thermosensitive recording medium utilizing a salt of a bis(hydroxyphenyl)acetic acid or butyric acid and a higher aliphatic amine. These salts have a reversible color developing function and decolorizing function. Specifically when these salts are thermally decomposed to liberate the above-mentioned amines, those amines have a decolorizing function. With this type of recording media, a colored image can be developed in a specific temperature range with the application of heat thereto, and can be decolorized or erased by applying heat thereto at a higher temperature than the above-mentioned specific temperature range. However, since the color developing function and the decolorizing function are competitively effected, it is difficult to thermally control these functions by changing the temperature of the recording medium. Therefore, it is difficult to obtain a stable image contrast.

As mentioned above, the conventional reversible thermosensitive recording media utilizing the coloring reaction between a coloring agent and a color developer have many problems and are unsatisfactory for use in practice.

Conventionally, there has been a large demand for a multi-color recording medium. Recently, a reversible thermo-sensitive coloring recording medium capable of forming images thereon in two colors has become usable in practice, and in fact used for labels, coupon tickets, label sheets with an adhesive layer and a release backing paper applied thereto, and video printers. The above-mentioned reversible thermosensitive recording medium is fabricated by laminating a high temperature coloring layer and a low temperature coloring layer on a support. These coloring layers respectively produce a different color by the application of a different amount of energy.

For producing two different colors by use of the above reversible thermosensitive recording medium, two methods have been proposed.

In one method, a colored image produced in the low temperature coloring layer is not decolorized when a colored image is produced in the high temperature coloring layer, so that the resultant image produced in the reversible thermosensitive recording medium has a mixed color of the color produced in the low temperature coloring layer and the color in the high temperature coloring layer.

In the other method, when a colored image is produced in the high temperature coloring layer, a colored image produced simultaneously in the low temperature coloring is erased by use of an appropriate decolorizing agent.

In the former method, however, if the color produced in the high temperature coloring layer cannot sufficiently conceal the color produced in the low temperature coloring layer, two-colored images with a sufficiently high contrast for practical use cannot be obtained. For instance, when the color produced in the low temperature coloring layer is black, it is impossible to obtain two-colored images.

On the other hand, in the latter method, any combination of colors can be employed. However, an appropriate decolorizing agent for the above-mentioned purpose, capable of satisfying the requirement for the color development and decolorization of the recording medium, has not been found.

In addition to the above, it is difficult to obtain a multi-color or full-color reversible thermosensitive coloring recording medium capable of producing three or more colors, and a satisfactory reversible thermosensitive coloring image formation method has not yet been developed.

As mentioned above, there is a large demand for a multi-color recording medium, and it is considered that a practically usable multi-color recording medium offers substantial market potential.

However, studies on a reversible thermosensitive recording medium, particularly on a multi-color reversible thermosensitive recording medium, have just been started. It is generally considered that it will be difficult to obtain a multi-color image on a reversible thermosensitive recording medium by the conventionally employed method.

For instance, attention is paid to a thermal display using a metal-complex-based thermochromic material as being a simple display medium on which images can be reversibly written and erased. However, the thermal display has a problem in image contrast and is not satisfactory for use in practice. In addition, a thermal display medium utilizing the changes in the transparency of an organic compound depending upon the temperature thereof has been proposed. The thermal display medium, however, forms only black and white images, so that it is not suitable to use it as a display which is required to have a visual appeal or as an electron black board.

SUMMARY OF THE INVENTION

A first object of the present invention is to provide a reversible thermosensitive coloring recording method for producing multi-color images by use of a reversible thermosensitive coloring recording medium capable of reversibly producing multi-color images thereon repeatedly.

A second object of the present invention is to provide a method of initializing the above-mentioned reversible thermosensitive recording medium by which a reversible thermosensitive coloring recording layer in the reversible thermosensitive coloring recording medium in the color development state is brought into the initial decolorization state.

A third object of the present invention is to provide the above-mentioned reversible thermosensitive coloring recording medium.

A fourth object of the present invention is to provide a recording apparatus for reversibly producing multi-color images on the above-mentioned reversible thermosensitive coloring recording method, or for performing the above-mentioned initialization for the reversible thermosensitive coloring recording media.

The first object of the present invention can be achieved by a reversible thermosensitive coloring recording method for producing multi-color images by use of a reversible thermosensitive coloring recording medium which comprises a support and a reversible thermosensitive coloring recording layer formed thereon, the reversible thermosensitive coloring recording layer comprising a plurality of reversible thermosensitive coloring compositions, each of the reversible thermosensitive coloring compositions being independently present separated from the other reversible thermosensitive coloring compositions, and capable of reversibly forming a color development state with a different color in a predetermined color development temperature range, and a decolorization state in a predetermined decolorization temperature range by the application of heat thereto and maintaining the color development state and the decolorization state at room temperature, the decolorization temperature range being located lower in terms of temperature than the color development temperature range therefor, comprising the steps of (a) temporarily applying heat to the reversible thermosensitive coloring recording medium to a color development temperature at which at least two of the reversible thermosensitive coloring compositions are colored or to a temperature higher than the color development temperature to obtain a mixed coloring state, and (b) decolorizing at least one of the reversible thermosensitive coloring compositions which have been colored, thereby producing multi-color images.

The second object of the present invention can be achieved by a method of initializing the above-mentioned reversible thermosensitive coloring recording medium for producing multi-color images, comprising the step of bringing all of the reversible thermosensitive coloring compositions into the respective decolorization states thereof to decolorize the multi-color images by successively decolorizing the reversible thermosensitive coloring compositions in the order of from a reversible thermosensitive coloring composition with a higher decolorization temperature range to a reversible thermosensitive coloring composition with a lower decolorization temperature range.

The third object of the present invention can be achieved by a reversible thermosensitive coloring recording medium comprising a support, and a reversible thermosensitive coloring recording layer formed thereon, the reversible thermosensitive coloring recording layer comprising a plurality of reversible thermosensitive coloring compositions, each of the reversible thermosensitive coloring compositions being independently present separated from the other reversible thermosensitive coloring compositions, and capable of reversibly forming a color development state with a different color in a predetermined color development temperature range, and a decolorization state in a predetermined decolorization temperature range by the application of heat thereto and maintaining the color development state and the decolorization state at room temperature, the decolorization temperature range being located lower in terms of temperature than the color development temperature range therefor.

The fourth object of the present invention can be achieved by a recording apparatus for producing multi-color images on the above-mentioned reversible thermosensitive coloring recording medium, or for initializing the same comprising first heat generating means for applying heat imagewise to the reversible thermosensitive coloring recording medium to the color development temperature range of any of the reversible thermosensitive coloring compositions, second heat generating means for applying heat imagewise to the reversible thermosensitive coloring recording medium to the decolorization temperature range of any of the reversible thermosensitive coloring compositions, and third heat generating means for applying heat to the entire surface of the reversible thermosensitive coloring recording medium to the decolorization temperature range of each of the reversible thermosensitive coloring compositions.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 7(*b*) is a diagram showing the basic structure of another recording apparatus used with a reversible thermosensitive coloring recording medium according to the present invention, which is employed as an endless-belt-shaped display medium.

DETAILED DESCRIPTION OF THE PREFERRED EMBODIMENT

Figure 1:
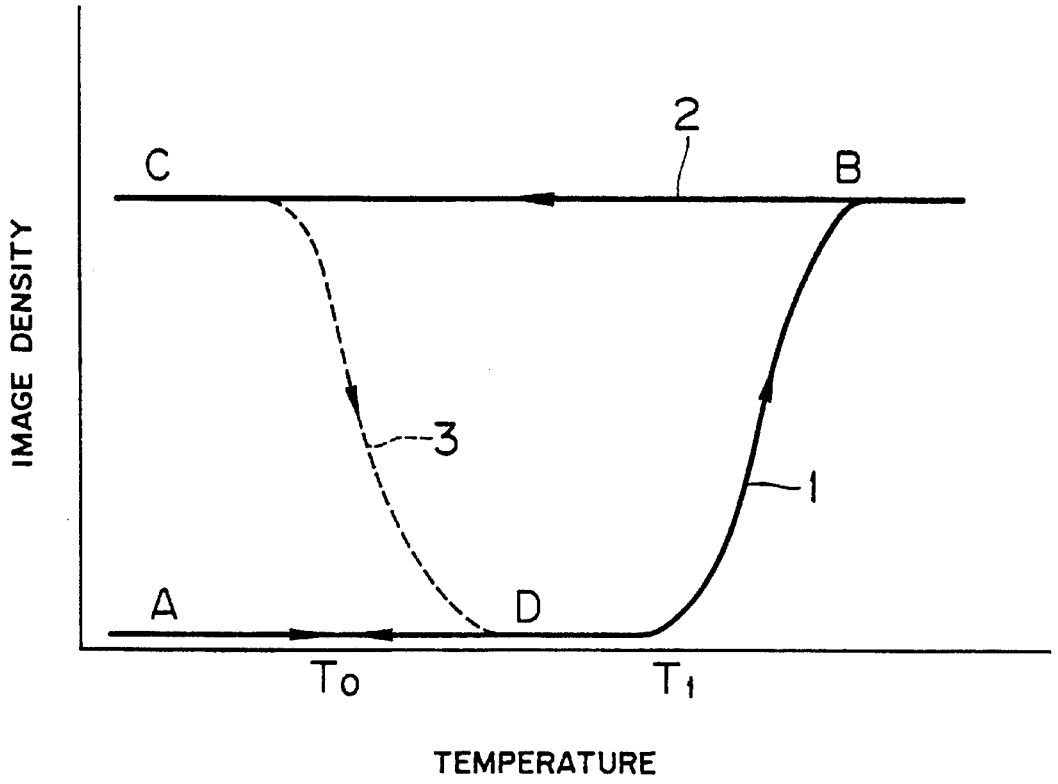
FIG. 1 is a diagram for explaining the principle of the color development and decolorization, that is, the image formation and image erasure in a reversible thermosensitive coloring recoding layer of a reversible thermosensitive coloring recording medium of the present invention.

The reversible thermosensitive coloring recording medium according to the present invention comprises a support and a reversible thermosensitive coloring recording layer formed thereon, the reversible thermosensitive recording layer comprising a plurality of coloring compositions. Each reversible thermosensitive coloring composition for use in the present invention comprises a coloring agent which is an electron-donor coloring compound, and a color developer which is an electron-acceptor compound, capable of reacting with the coloring agent to induce color formation in the coloring agent at the eutectic temperature thereof with the application of heat thereto. Each of the coloring compositions is independently present separated from the other reversible thermosensitive coloring compositions.

Furthermore, the recording layer may comprise a plurality of coloring composition layers which is successively overlaid. When the reversible thermosensitive coloring recording layer comprises a plurality coloring composition layers, each of the coloring composition layers comprising one of the reversible thermosensitive coloring compositions.

Each of the coloring compositions forms a color development state with a different color in a predetermined color development temperature range and a decolorization state in a predetermined decolorization temperature range. Therefore, when heat is applied so as to correspond to an image to the reversible thermosensitive recording medium of the present invention at a temperature at which all of the coloring composition layers assume their respective color development states, the recording medium forms a corresponding image which its entirety assumes a mixed coloring state.

When heat is further applied imagewise, corresponding to the same image as mentioned above, at a specific decolorizing temperature, to the reversible thermosensitive coloring recording medium in the mixed coloring state, a mixed colored image with a specific color being decolorized at the specific decolorizing temperature, or a single color image is formed.

By repeating such operation, a single colored image or a mixed colored image can be obtained as desired.

The reversible thermosensitive coloring recording medium according to the present invention may further comprise an irreversible thermosensitive coloring composition in the reversible thermosensitive coloring recording layer. The irreversible thermosensitive coloring composition is independently present separated from the reversible thermosensitive coloring compositions.

The irreversible thermosensitive composition may be included in the form of an irreversible thermosensitive recording layer which comprises the irreversible thermosensitive coloring composition, which can be overlaid on or beside the reversible thermosensitive coloring recording layer. The irreversible coloring composition layer, once colored, cannot be decolorized so that it is suitable to be used as the background color layer of the recording medium.

The color formation of each of the coloring composition layers can be carried out instantly by the application of heat thereto, and the color development state of each of the coloring composition layers can be stably maintained at room temperature. On the other hand, each of the coloring composition layers in the color development state can be instantly decolorized by the application of heat thereto at a temperature in the decolorization temperature range which is located lower in terms of temperature than the corresponding color development temperature range, and the decolorization state can also be stably maintained at room temperature.

The principle of the color development and decolorization, that is, the image formation and image erasure in a reversible thermosensitive coloring recording layer of a reversible thermosensitive coloring recording medium of the present invention will now be explained with reference to FIG. 1.

In the diagram shown in FIG. 1, the relationship between the coloring density of the reversible thermosensitive coloring layer of the reversible thermosensitive coloring recording medium according to the present invention and the temperature thereof is shown with the coloring density or image as ordinate and the temperature as abscissa.

A solid line 1 in FIG. 1 indicates the process of image formation, and a broken line 3 indicates the process of decolorization. Reference symbol A indicates the image density at a complete decolorization state; reference symbol B, the image density in a complete color development state with the application of heat to a temperature $T_1$ or more; reference symbol C, the image density in the complete color development state at a temperature $T_0$ or less; and reference symbol D, the image density in the decolorization state obtained with the application of heat to a temperature between $T_0$ and $T_1$.

The reversible thermosensitive coloring recording layer for use in the present invention is supposed be in a colorless state, which is referred to as the initial decolorization state (A) with the image density A at a temperature $T_0$ or less. When the temperature of the recording layer is increased and reaches the temperature $T_1$ or more by the application of heat thereto using a thermal head, an image in a color development state (B) with the image density B is obtained. While the temperature of the recording layer in the color development state (B) is decreased to a temperature $T_0$ or less passing along the path indicated by the solid line 2, the color development state is maintained and the recording layer assumes a color development state (C) with the same image density B. Thus, information recorded in the recording layer is not lost at the temperature $T_0$ or less.

When the temperature of the recording layer in the color development state (C) is increased again to a temperature between $T_0$ to $T_1$, which is located lower in terms of temperature than the color development initiation temperature at which the color development is carried out, the recording layer assumes a decolorization state (D) which is a colorless state. Even when the temperature of the recording layer in the decolorization state (D) is decreased to the temperature $T_0$ or less, the decolorization state of the recording layer is maintained, and the recording layer returns to the initial decolorization state (A).

Thus, the image formation process is carried out passing through the path shown by the solid lines ABC in FIG. 1, and reaching the image density C, which can be maintained at room temperature. The decolorization process is carried out passing through the path shown by the solid lines CDA in FIG. 1, and reaching the colorless state (A) with the image density A, which can be maintained at room temperature.

Such color development and decolorization can be reversibly performed on the reversible thermosensitive coloring recording medium repeatedly.

The coloring of each of the coloring composition layers for use in the present invention, which comprises a color developer and a coloring agent, takes place when the color developer and the coloring agent are heated to a eutectic temperature thereof and react to produce a colored material. The color development state can be maintained even by cooling the same to room temperature. Since this coloring composition has a decolorization temperature range located lower in terms of temperature than the eutectic temperature of the coloring composition, it is desirable to promptly cool the coloring composition in the color development state in order to maintain the color development state at room temperature.

If the coloring composition in the color development state is gradually cooled, the color density is often decreased because of the occurrence of the decolorization at the stage passing through the decolorization temperature range.

It is considered that the colored material which is produced by the reaction between the coloring agent and the color developer is in the state where the lactone ring of the coloring agent is open. The coloring composition, after rapidly cooled from a fused state, contains the molecules of the colored material, and the molecules of the color developer and the coloring agent which do not directly contribute to the formation of the colored material. In the color development state of the coloring composition, all of these components are solidified by the cohesive forces therebetween.

The coloring composition for use in the present invention is solid in the color development state. The solidified coloring composition has some regularity in the aggregation structure. Some exhibit high regularities and some exhibit low regularities. The degree of the regularity depends on the combination or mixing ratio of the color developer and the coloring agent, and the cooling conditions for the coloring composition. It is considered that the aggregation structure of the coloring composition is supported mainly by the cohesion force which works between a long-chain moiety of the color developer which involved in the formation of the colored material and a long-chain moiety of an excessive color developer which is not involved in the formation of the colored material. Such an aggregation structure is considered to relate to the decolorization phenomenon of the coloring composition.

The reversible thermosensitive coloring composition in a color development state in the reversible thermosensitive coloring recording medium according to the present invention can be decolorized by the application of heat thereto to a temperature in a specific temperature range. The aggregation structure of the coloring composition in the color development state is changed in the course of the decolorization process to reach a state where the molecules of the color developer are separated in the form of crystals from the colored material, so that a stable decolorization state is attained. This phenomenon is confirmed by X-ray diffraction. Thus, in the present invention, the long alkyl chain moiety of the color developer is considered to play an important role in the formation of the colored material in the color development process, and also in the above described decolorization process. This is a key feature of the reversible thermosensitive coloring composition in the present invention. Therefore, the color development initiation temperature and the decolorization initiation temperature can be controlled by changing the length of the alkyl chain of the color developer. As the length of the alkyl chain increases, both of the color development initiation temperature and the decolorization initiation temperature are shifted toward a higher temperature side. This is because the cohesive force and the mobility of the color developer differ depending upon the length of the alkyl chain.

Figure 2:
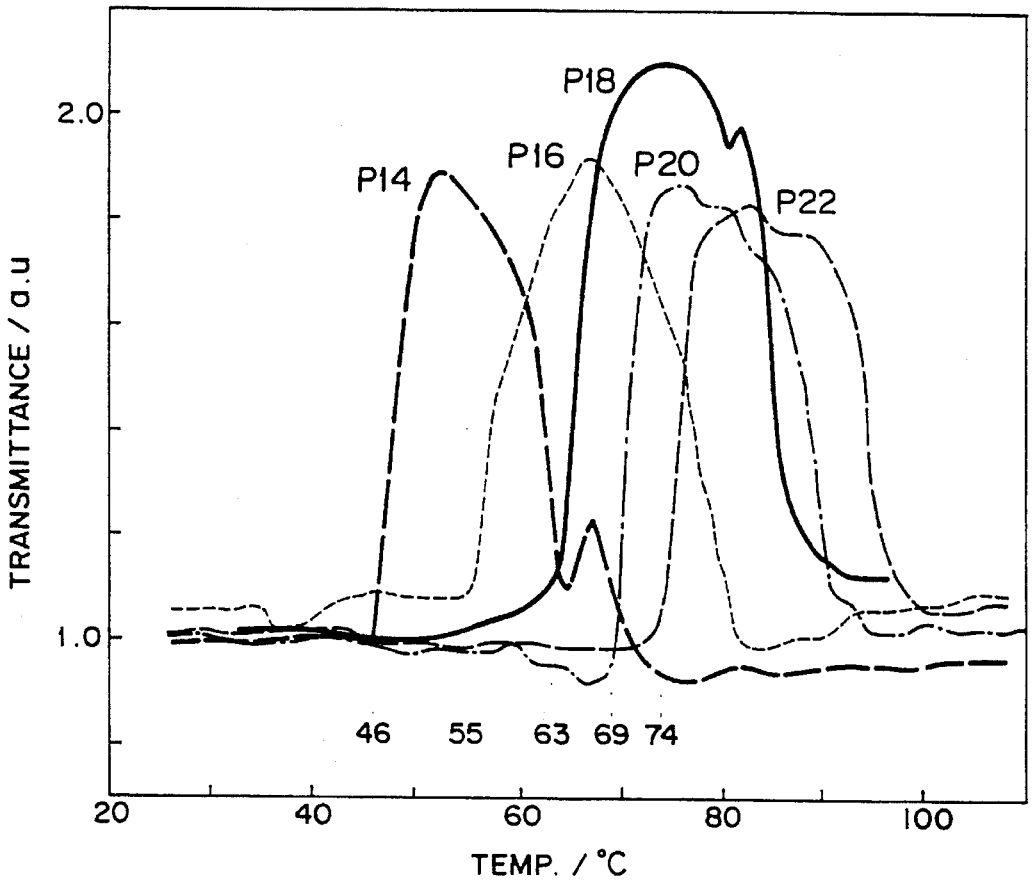
FIG. 2 is a diagram showing the changes of the decolorization temperature range of a reversible thermosensitive coloring composition comprising a phosphonic acid serving as a color developer, depending upon of the length of the alkyl chain of the color developer, in which the number suffixed to P indicates the number of the carbon atoms of the alkyl group of the phosphonic acid.

More specifically, the relationship between the length of the alkyl chain of the color developer and the color development and decolorization initiation temperatures are shown in Table 1 and FIG. 2:

TABLE 1

| Length of Alkyl Chain in Phosphonic Acid | Decolorization Initiation Temperature (°C.) | Color Development Initiation Temperature (°C.) |
|---|---|---|
| 14 | 48 | 72 |
| 16 | 56 | 78 |
| 18 | 64 | 85 |
| 20 | 69 | 96 |

Table 1 and FIG. 2 show the relationship between the color development and decolorization initiation temperatures and the length of the alkyl chain of each phosphonic acid with a different length of alkyl chain, when the reversible thermosensitive coloring composition comprises phosphonic acid as a color developer and 2-(o-chloroanilino)-6-dibutylaminofluoran as a coloring agent. The number of each of P14 to P22 affixed to each curve in FIG. 2 indicates the number of the carbon atoms of the alkyl group, that is, the length of the alkyl group of each phosphonic acid.

The changes in the optical transmittance of the colored material is measured as the temperature of the colored material is increased, as shown in FIG. 2. In this measurement, the initial optical transmittance of the colored material is supposed to be 1.0 as shown in FIG. 2.

Therefore in this diagram, the temperature at which each curve begins to rise corresponds to the decolorization initiation temperature, and the temperature at which each curve falls and reaches the initial optical transmittance corresponds to the color development initiation temperature.

FIG. 2 clearly shows that each of the decolorization initiation temperature and the color development initiation temperature is shifted to a higher temperature side in the graph as the length of the alkyl chain increases.

The reversible thermosensitive coloring composition according to the present invention is basically obtained by combining the previously mentioned color developer with a long chain structure and the coloring agent. An appropriate coloring agent is present for each color developer. The combination of the color developer and the coloring agent is appropriately selected in accordance with such characteristics as the ease of decolorization and the color of the coloring composition in the color development state.

The decolorizing properties of the coloring composition can be assessed by the presence or absence of exothermic peaks observed in the temperature elevation course in the differential thermal analysis (DTA) or differential scanning calorimetric analysis (DSC) of the coloring composition in a color development state.

The exothermic peaks correspond to the decolorizing properties which characterize the present invention, and can be employed as a standard for selecting the appropriate combination of the color developer and the coloring agent to obtain excellent decolorizing properties.

Furthermore, the reversible thermosensitive coloring recording layer for use in the present invention may comprise a third material other than the coloring agent and the color developer. For example, the color development state and the decolorization state can be reversibly obtained when a polymeric compound is also contained in the recording layer.

The multi-color image formation mechanism using the reversible thermosensitive coloring recording medium according to the present invention will now be explained in detail.

As mentioned previously, the reversible thermosensitive coloring recording medium comprises a support and a reversible thermosensitive coloring recording layer formed thereon, the reversible thermosensitive coloring recording layer comprising a plurality of reversible thermosensitive coloring compositions. Each of the reversible thermosensitive coloring compositions is independently present separated from the other coloring compositions and is capable of reversibly forming a color development state with a different color in the color development state in the color development temperature range and a decolorization state in the decolorization temperature range by the application of heat thereto and maintaining the color development state and the decolorization state at room temperature. The decolorization temperature range is located lower in terms of temperature than the corresponding color development temperature range.

The reversible thermosensitive coloring recording layer may comprise a plurality of coloring composition layers, which is successively overlaid, each of the coloring composition layers comprising one of the reversible thermosensitive coloring compositions.

In the reversible thermosensitive coloring recording medium according to the present invention, color formation is induced in each of a plurality of the coloring composition layers and some of the color-induced coloring composition layers can be decolorized if necessary, so that a multi-color image or a single color image can be obtained as desired.

Such colored image formation is made possible because the decolorization initiation temperature of each coloring composition layer for use in the present invention is located lower in terms of temperature than the color development initiation temperature thereof, and the color development and decolorization initiation temperatures can be controlled by selecting materials for the reversible thermosensitive coloring recording medium, in particular, the color developer. In this sense, the reversible thermosensitive coloring recording medium according to the present invention is outstandingly better than a conventional reversible thermosensitive coloring recording medium.

The reversible thermosensitive coloring recording layer may further comprise an irreversible thermosensitive coloring composition in such a manner that the irreversible coloring composition is independently present separated from the reversible thermosensitive coloring compositions in the recording layer.

Alternatively, the recording medium may comprise an irreversible thermosensitive recording layer which comprises the irreversible thermosensitive coloring composition, which can be overlaid on or beside the reversible thermosensitive coloring recording layer.

Moreover, the reversible thermosensitive coloring recording medium comprising a plurality of coloring composition layers may further comprise at least one intermediate layer between the coloring composition layers. It is preferable that the intermediate layer for use in the present invention comprise a water-soluble resin or a heat-resistant resin. By the provision of the intermediate layer comprising a heat-resistant resin, the coloring composition layers are prevented from being fused and mixed under the application of heat thereto.

The multi-color image formation mechanism in the present invention will now be explained with reference to FIGS. 3 and 4.

Figure 3:
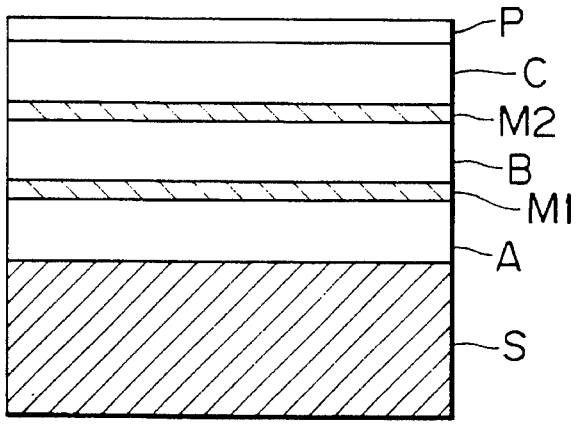
FIG. 3 is a schematic cross-sectional view of a basic structure of a reversible thermosensitive coloring recording medium according to the present invention.

FIG. 3 is a cross-sectional view of a reversible thermosensitive coloring recording medium according to the present invention, showing a basic structure thereof.

In FIG. 3, a first coloring composition layer A, a second coloring composition layer B, and a third coloring composition layer C are successively overlaid on a support S.

A first intermediate layer M1 and a second intermediate layer M2, which may comprise a resin such as a heat resistant resin or a water-soluble resin, are respectively interposed between the first and second coloring composition layers A and B, and between the second and third coloring composition layers B and C. A protective layer P is overlaid on the third coloring composition layer C.

Figures 4A, 4B, 4C:
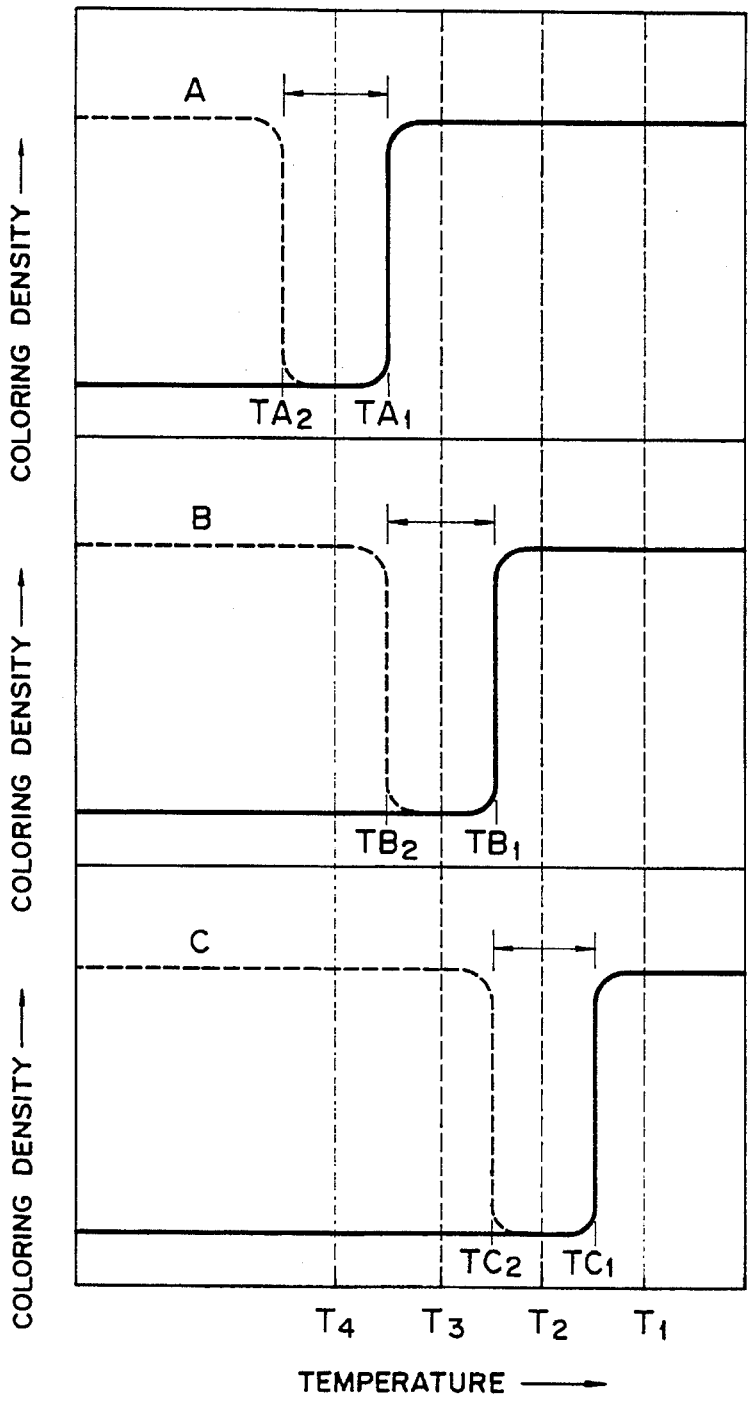
FIGS. 4(*a*) to 4(*c*) are diagrams showing an example of the relationship among the color development initiation temperature, the decolorization initiation temperature and the decolorization temperature range of an example of a reversible thermosensitive coloring recording medium comprising three coloring composition layers A, B and C.

FIG. 4(*a*), FIG. 4(*b*), and FIG. 4(*c*) are diagrams showing the relationship between the color development initiation temperature and the decolorization initiation temperature of the reversible thermosensitive coloring recording medium comprising coloring composition layers A, B, and C as shown in FIG. 3, with the temperature of each of the coloring composition layer as abscissa and the coloring density thereof as ordinate. In the diagrams, the solid line curves indicate the changes in the coloring density of each coloring composition layer in the decolorization state when the temperature thereof is increased. For example, the coloring density of the coloring composition layer A begins to increase at a temperature $TA_1$, and the coloring composition layer A assumes a color development state at the temperature $TA_1$ or more as shown in FIG. 4(*a*). The temperature $TA_1$ is supposed to be a color development initiation temperature of the coloring composition layer A. In the same way, the color development initiation temperatures of the coloring composition layers B and C are respectively $TB_1$ and $TC_1$ as shown in FIGS. 4(*b*) and 4(*c*).

Moreover, the broken line curves in FIGS. 4(*a*), 4(*b*), and 4(*c*) indicate the changes in coloring density of the respective coloring composition layers A, B and C in the color development state when the temperature thereof is increased. For example, the density of the coloring composition layer A suddenly falls at a temperature $TA_2$ as shown in FIG. 4(*a*) to reach a decolorization state. The temperature $TA_2$ is supposed to be a decolorization initiation temperature of the coloring composition layer A. In the same way, the color development initiation temperatures of the coloring composition layers B and C are respectively $TB_2$ and $TC_2$ as shown in FIGS. 4(*b*) and 4(*c*).

As is obvious from these diagrams, the coloring composition layers A, B and C have different color development temperatures and decolorization temperatures, and each decolorization temperature range indicated by the arrows, between the color development initiation temperature (for instance, $TA_1$, $TB_1$, or $TC_1$) and the decolorization initiation temperature (for instance $TA_2$, $TB_2$, or $TC_2$) is relatively shifted.

A reversible thermosensitive coloring recording method according to the present invention comprises the steps of temporarily applying heat to the reversible thermosensitive coloring recording medium according of the present invention to the color development temperature at which at least two of the reversible thermosensitive coloring compositions are colored or a temperature higher than the color development temperature to obtain a mixed coloring state, and decolorizing at least one of the reversible thermosensitive coloring compositions which have been colored, thereby producing multi-color images.

More specifically, the reversible thermosensitive coloring recording method for producing multi-color images according to the present invention will now be explained with reference to a reversible thermosensitive coloring recording medium comprising a reversible thermosensitive recording layer comprising three coloring composition layers, each of the coloring composition layers having a different color development initiation temperature and a different decolorization initiation temperature as shown in FIGS. 4(*a*) to 4(*c*).

The decolorization initiation temperature of the coloring composition layer A is the lowest of the decolorization initiation temperatures of the three layers, the decolorization initiation temperature of the coloring composition layer C, the highest, and the decolorization initiation temperature of the coloring composition layer B, midway between the lowest and the highest.

When heat is temporarily applied to the reversible thermosensitive coloring recording medium to a temperature $T_1$ which is higher than the color development initiation temperature $TC_1$ of the coloring composition layer C, followed by cooling, not only the coloring composition layer C, but also the coloring composition layers A and B assume the respective color development states, so that the recording medium assumes a mixed coloring state of the three layers A, B and C.

Subsequently, when the recording medium in the above-mentioned mixed coloring state is temporarily heated to a temperature $T_3$ ($TA_1<T_3<TC_2$) which is in the decolorization temperature range of the coloring composition layer B, followed by cooling, the coloring composition layer B is decolorized, but the color development states of the coloring composition layers A and C are maintained, since the temperature $T_3$ is higher than the color development initiation temperature $TA_1$ of the coloring composition layer A and lower than the decolorization initiation temperature $TC_2$ of the coloring composition layer C. Therefore, when the recording medium in the mixed coloring state of the coloring composition layers A, B and C is temporarily heated to the temperature $T_3$, the recording medium assumes a mixed coloring state of the coloring composition layers A and C.

Furthermore, when the recording medium in the mixed coloring state of the coloring composition layers A and C is temporarily heated to a temperature $T_4$ ($TA_2<T_4<TB_2$) which is in the decolorization temperature range of the coloring composition layer A, followed by cooling, only the coloring composition layer A is decolorized and the color development state of the coloring composition layer C is maintained, so that the recording medium assumes the single color of the coloring composition layer C.

In the same way as described above, when the recording medium in the decolorization state is heated to a temperature $T_2$ which is higher than the color development initiation temperature $TB_1$ of the coloring composition layer B and in the decolorization temperature range of the coloring composition layer C, the recording medium is caused to assume the mixed coloring state of the coloring composition layers A and B. Thereafter, when the recording medium in the above-mentioned mixed coloring state is temporarily heated to the temperature $T_4$, the recording medium assumes the color of the coloring composition layer B in the color development state.

When heat is temporarily applied to the recording medium in the mixed coloring state of the coloring composition layers A, B and C (which is obtained by heating the recording medium to the temperature $T_1$) to the temperature $T_4$, only the coloring composition layer A is decolorized and the recording medium in the mixed coloring state of the coloring composition layers B and C can be obtained.

Moreover, the recording medium in the decolorization state is temporarily heated to the temperature $T_3$, only the coloring composition layer A is in the color development state, and the recording medium assumes the color of the coloring composition layer A in the color development state.

The following Table 2 shows the relationship between the temperatures of the recording medium and the colors obtained in the recording medium.

TABLE 2

| Heating Temperature | Obtained Color |
|---|---|
| $T_1$ | Mixed color (A, B, C) |
| $T_2$ | Mixed color (A, B) |
| $T_1 \rightarrow T_3$ | Mixed color (A, C) |
| $T_1 \rightarrow T_4$ | Mixed color (B, C) |
| $T_1 \rightarrow T_3 \rightarrow T_4$ | Single color (C) |
| $T_2 \rightarrow T_4$ | Single color (B) |
| $T_3$ | Single color (A) |

In Table 2 the term "Heating Temperature" indicates a temperature to which heat is temporarily applied to the reversible thermosensitive recording medium. For instance, $T_1 \rightarrow T_3$ means temporary application of heat to the temperature $T_1$, followed by cooling, and then to the temperature $T_3$, again followed by cooling.

The above explained reversible thermosensitive coloring recording method according to the present invention can also be employed when producing multi-color images by a reversible thermosensitive coloring recording medium which comprises two to four or more coloring composition layers. When the recording medium comprises two coloring composition layers, three-color images, with two single colors and one mixed color, can be produced. Moreover, when the recording medium comprises three coloring composition layers, 7-color images can be formed, and when the recording medium comprises four coloring composition layers, 15-color images can be formed.

As can be seen from the above explanation, each of the coloring composition layers in the color development state can be initialized to assume the initial decolorization state by bringing all of the reversible thermosensitive coloring compositions contained in the respective coloring composition layers, into the respective decolorization states thereof to decolorize the multi-color images by successively decolorizing the reversible thermosensitive coloring compositions in the order of from a reversible thermo-sensitive composition contained in a coloring composition layer with a higher decolorization temperature range to a reversible thermosensitive coloring composition in a coloring composition layer with a lower decolorization temperature range. Thus, the recording medium in the color development state can be caused to assume the initial decolorization state. Accordingly, the formation of multi-color images and the erasure thereof can be repeatedly performed on the reversible thermosensitive coloring recording medium in accordance with the reversible thermosensitive coloring recording method of the present invention.

Figures 5A, 5B, 5C:
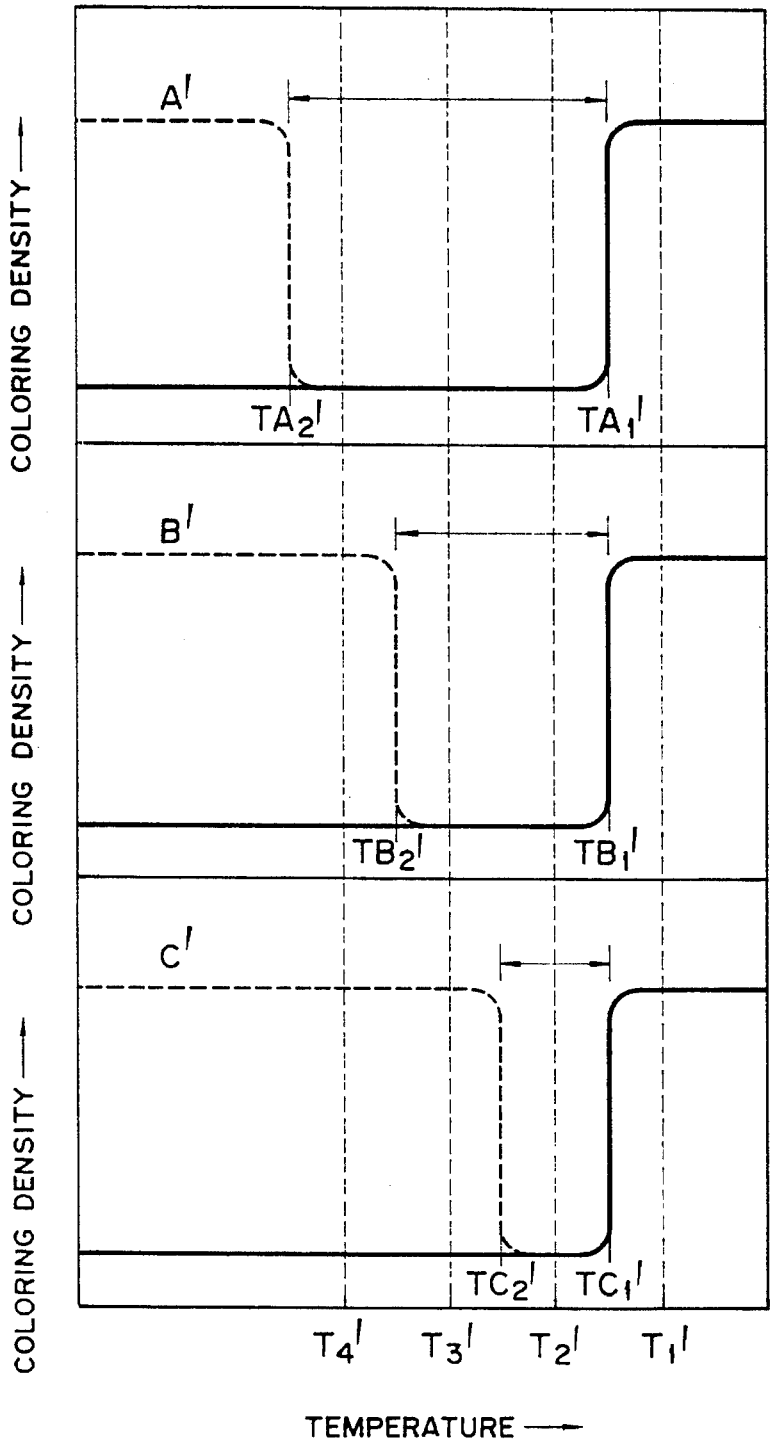
FIGS. 5(*a*) to 5(*c*) are diagrams showing the relationship among the color development initiation temperature, the decolorization initiation temperature and the decolorization temperature range of another example of a reversible thermosensitive coloring recording medium comprising three coloring composition layers A', B' and C'.

FIG. 5(*a*), FIG. 5(*b*), and FIG. 5(*c*) are the diagrams showing the relationship between the color development initiation temperature and the decolorization initiation temperature of another reversible thermosensitive coloring recording medium comprising coloring composition layers A', B' and C', with the temperature of each of the coloring composition layers as abscissa and the coloring density thereof as ordinate. In the diagrams, the solid line curves indicate the changes in the image density of each coloring composition layer in the decolorization state when the temperature thereof is increased, and the broken line curves indicate the changes in the coloring image density of each coloring composition layer in the color development state when the temperature thereof is increased. More specifically, FIG. 5(*a*), FIG. 5(*b*) and FIG. 5(*c*) respectively show the changes in the coloring density of the coloring composition layer A', the coloring composition layer B', and the coloring composition layer C', depending upon the temperature thereof. The three coloring composition layers A', B' and C' have almost the same color development initiation temperatures $TA_1'$, $TB_1'$ and $TC_1'$, and different decolorization initiation temperatures $TA_2'$, $TB_2'$ and $TC_2'$, respectively, as shown in FIGS. 5(*a*) to 5(*c*). The range between the decolorization initiation temperature and the color development initiation temperature shown by the arrows in each diagram is the decolorization temperature range.

Initially, the three coloring composition layers A', B', and C' are temporarily heated to a temperature $T_1'$ at which all the three coloring composition layers assume the respective color development states, so that the recording medium in the mixed coloring state of the coloring composition layers A', B' and C' is obtained. Subsequently, when the recording medium in the mixed coloring state of the coloring composition layers A', B', and C' is temporarily heated to a temperature $T_4'$ a mixed color of the coloring composition layers B' and C' is obtained since only the coloring composition layer A' is decolorized.

Moreover, when heat is temporarily applied to the recording medium in the mixed coloring state of the coloring composition layers A', B' and C' to a temperature $T_3'$, the coloring composition layers A' and B' are decolorized so that the recording medium in the color of the coloring composition layer C' is obtained, while when the recording medium in the mixed coloring state of the coloring composition layers B' and C' is temporarily heated to the temperature $T_3'$, the coloring composition layer B' is decolorized so that the recording medium also in the color of the coloring composition layer C' is obtained. Therefore, in this case, only three colors can be obtained on the reversible thermosensitive coloring recording medium comprising the three coloring composition layers.

As is obvious from the above explanation, the reversible thermosensitive coloring recording medium comprising the three coloring composition layers with the same color development initiation temperature and different decolorization initiation temperatures, the number of colors obtained on the reversible thermosensitive coloring recording medium is decreased, which is not preferable in the present invention, when compared with the previously mentioned recording medium comprising three coloring composition layers, as shown in FIGS. 4(*a*) to 4(*c*), which is capable of producing 7 colors.

Therefore, it is preferable that each of the coloring composition layers comprise a reversible thermosensitive coloring composition with a different color development initiation temperature and a different decolorization initiation temperature, as shown in FIGS. 4(*a*) to 4(*c*).

The color developer to be employed in combination with a coloring agent in the reversible thermosensitive coloring composition in the present invention includes not only a molecular structure having a capability of inducing color formation in the coloring agent, but also a long aliphatic chain moiety in the molecule which controls the cohesion between the molecules thereof.

Representative examples of preferable color developers for use in the present invention include an organic phosphoric acid compound, an aliphatic carboxylic acid, and a phenolic compound, each having an aliphatic group having 12 or more carbon atoms; and a metallic salt of mercaptoacetic acid with an aliphatic group having 10 to 18 carbon atoms. Examples of the aliphatic group include a straight-chain or branched chain alkyl group, and a straight-chain or branched chain alkenyl group. The aliphatic group may have a substituent such as halogen, an alkoxyl group, or an ester group.

More specifically, organic phosphoric acid compounds represented by the following general formula (I) can be preferably employed as color developers for use in the present invention:

$$R^1\text{-}PO(OH)_2 \quad (I)$$

wherein $R^1$ represents an aliphatic group having 12 or more carbon atoms.

Specific examples of the organic phosphoric acid compounds represented by general formula (I) are as follows: dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, and octacosylphosphonic acid.

As the aliphatic carboxylic acid compound for use in the color developer, -hydroxycarboxylic acids represented by the following general formula (II) can be employed:

$$R^2\text{—}CH(OH)\text{—}COOH \quad (II)$$

wherein $R^2$ represents an aliphatic group having 12 or more carbon atoms.

Specific examples of the α-hydroxycarboxylic acids represented by general formula (II) are as follows: α-hydroxydodecanoic acid, α-hydroxytetradecanoic acid, α-hydroxyhexadecanoic acid, α-hydroxyoctadecanoic acid, α-hydroxypentadecanoic acid, α-hydroxyeicosanoic acid, α-hydroxydocosanoic acid, α-hydroxytetracosanoic acid, α-hydroxyhexacosanoic acid and α-hydroxyoctacosanoic acid.

Furthermore, as the aliphatic carboxylic acid compounds for use in the color developer, halogen-substituted compounds having an aliphatic group having 12 or more carbon atoms, with the halogen bonded to at least one carbon atom at α-position or β-position of the compound can be employed.

Specific examples of such halogen-substituted compounds are as follows: 2-chlorooctadecanoic acid, heptadeca fluorononadecanoic acid acid, 2-bromohexadecanoic acid, 2-bromoheptadecanoic acid, 2-bromooctadecanoic acid, 2-bromoeicosanoic acid, 2-bromodocosanoic acid, 2-bromotetracosanoic acid, 3-bromooctadecanoic acid, 3-bromoeicosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocosanoic acid, 2-iodohexadecanoic acid, 2-iodooctadecanoic acid, 3-iodohexadecanoic acid, 3-iodooctadecanoic acid, and perfluorooctadecanoic acid.

As the aliphatic carboxylic acid compound for use in the color developer, compounds having an aliphatic group having 12 or more carbon atoms, including an oxo group with at least one carbon atom at the α-position, β-position or γ-position of the aliphatic carboxylic acid compound constituting the oxo group can be employed.

Specific examples of such compounds are as follows: 2-oxododecanoic acid, 2-oxotetradecanoic acid, 2-oxohexadecanoic acid, 2-oxooctadecanoic acid, 2-oxoeicosanoic acid, 2-oxotetracosanoic acid, 3-oxododecanoic acid, 3-oxotetradecanoic acid, 3-oxohexadecanoic acid, 3-oxooctadecanoic acid, 3-oxoeicosanoic acid, 3-oxotetracosanoic acid, 4-oxohexadecanoic acid, 4-oxoheptadecanoic acid, 4-oxooctadecanoic acid, and 4-oxodocosanoic acid.

As the aliphatic carboxylic acid compound for use in the color developer, dibasic acid compounds represented by the following general formula (III) can be employed:

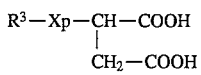

$$R^3\text{—}Xp\text{—}\underset{\underset{CH_2\text{—}COOH}{|}}{CH}\text{—}COOH \quad (III)$$

wherein $R^3$ represents an aliphatic group having 12 or more carbon atoms, X represents an oxygen or sulfur atom, p represents 1 or 2, and Xn may be $\text{—}SO_2\text{—}$ group.

Specific examples of the dibasic acids represented by general formula (III) are as follows: dodecylmalic acid, tetradecylmalic acid, hexadecylmalic acid, octadecylmalic acid, eicosylmalic acid, docosylmalic acid, tetracosylmalic acid, dodecylthiomalic acid, tetradecylthiomalic acid, hexadecylthiomalic acid, octadecylthiomalic acid, eicosylthiomalic acid, docosylthiomalic acid, tetracosylthiomalic acid, dodecyldithiomalic acid, tetradecyldithiomalic acid, hexadecyldithiomalic acid, octadecyldithiomalic acid, eicosyldithiomalic acid, docosyldithiomalic acid, tetracosyldithiomalic acid, dodecylsulfonyl butanedioic acid, tetradecylsulfonyl butanedioic acid, hexadecylsulfonyl butanedioic acid, octadecylsulfonyl butanedioic acid, eicosylsulfonyl butanedioic acid, and docosylsulfonyl butanedioic acid.

As the aliphatic carboxylic acid compound for use in the color developer, dibasic acid compounds represented by the following general formula (IV) can be employed:

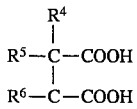

$$\begin{array}{c} R^4 \\ | \\ R^5\text{—}C\text{—}COOH \\ | \\ R^6\text{—}C\text{—}COOH \end{array} \quad (IV)$$

wherein $R^4$, $R^5$ and $R^6$ each represent hydrogen, and an aliphatic group, at least one of $R^4$, $R^5$ and $R^6$ being an aliphatic group having 12 or more carbon atoms.

Specific examples of the dibasic acid compounds represented by general formula (IV) are as follows: dodecylbutanedioic acid, tridecylbutanedioic acid, tetradecylbutanedioic acid, pentadecylbutanedioic acid, octadecylbutanedioic acid, eicosylbutanedioic acid, docosylbutanedioic acid, 2,3-dihexadecylbutanedioic acid, 2,3-dioctadecylbutanedioic acid, 2-methyl-3-dodecylbutanedioic acid, 2-methyl-3-tetradecylbutanedioic acid, 2-methyl-3-hexadecylbutanedioic acid, 2-ethyl-3-dodecylbutanedioic acid, 2-propyl-3-dodecylbutanedioic acid, 2-octyl-3-hexadecylbutanedioic acid, and 2-tetradecyl-3-octadecylbutanedioic acid.

As the aliphatic carboxylic acid compound for use in the color developer, dibasic acid compounds represented by the following general formula (V) can be employed:

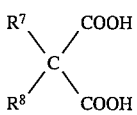

$$\begin{array}{ccc} R^7 & & COOH \\ & C & \\ R^8 & & COOH \end{array} \quad (V)$$

wherein $R^7$ and $R^8$ each represent hydrogen, and an aliphatic group, at least one of $R^7$ or $R^8$ being an aliphatic group having 12 or more carbon atoms.

Specific examples of the dibasic acid compounds represented by general formula (V) are as follows: dodecylmalonic acid, tetradecylmalonic acid, hexadecylmalonic acid, octadecylmalonic acid, eicosylmalonic acid, docosylmalonic acid, tetracosylmalonic acid, didodecylmalonic acid, ditetradecylmalonic acid, dihexadecylmalonic acid, dioctadecylmalonic acid, dieicosylmalonic acid, didocosylmalonic acid, methyloctadecylmalonic acid, methyleicosylmalonic acid, methyldocosylmalonic acid, methyltetracosylmalonic acid, ethyloctadecylmalonic acid, ethyleicosylmalonic acid, ethyldocosylmalonic acid, and ethyltetracosylmalonic acid.

As the aliphatic carboxylic acid compound for use in the color developer, dibasic acid compounds represented by the following general formula (VI) can be employed:

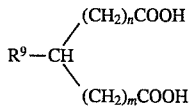

(VI)

wherein $R^9$ represents an aliphatic group having 12 or more carbon atoms; and n is an integer of 0 or 1, m is an integer of 1, 2 or 3, and when n is 0, m is 2 or 3, while when n is 1, m is 1 or 2.

Specific examples of the dibasic acid compound represented by general formula (VI) are as follows: 2-dodecyl-pentanedioic acid, 2-hexadecyl-pentanedioic acid, 2-octadecyl-pentanedioic acid, 2-eicosyl-pentanedioic acid, 2-docosyl-pentanedioic acid, 2-dodecyl-hexanedioic acid, 2-pentadecyl-hexanedioic acid, 2-octadecyl-hexanedioic acid, 2-eicosyl-hexanedioic acid, and 2-docosyl-hexanedioic acid.

In the present invention, as the aliphatic carboxylic acid compound for use in the color developer, tribasic acid compounds such as citric acid acylated by a long-chain aliphatic acid can also be employed. Specific examples of such compounds are as follows:

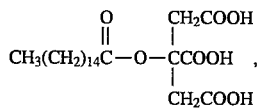

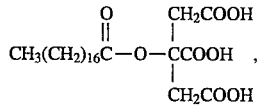

, and

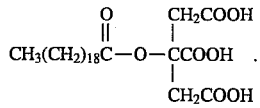

Furthermore, in the present invention, as the phenolic compound for use in the color developer, compounds represented by the following general formula (VII) can be employed:

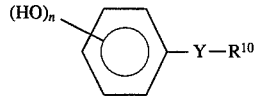

(VII)

wherein Y represents —S—, —O—, —CONH—, or —COO—; $R^{10}$ represents an aliphatic group having 12 or more carbon atoms; and n is an integer of 1 to 3.

Specific examples of the phenolic compounds represented by general formula (VII) are as follows: p-(dedecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate, octadecyl gallate, eicosyl gallate, docosyl gallate, and tetracosyl gallate.

As other organic phosphoric acid compound for use in the color developer, α-hydroxyalkyl phosphonic acid represented by the following general formula (VIII) can be employed.

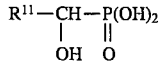

(VIII)

wherein $R^{11}$ represents an aliphatic group having 11 to 29 carbon atoms.

Specific examples of the α-hydroxyalkyl phosphonic acid represented by general formula (VIII) are as follows: α-hydroxydodecyl phosphonic acid, α-hydroxytetradecyl phosphonic acid, α-hydroxyhexadecyl phosphonic acid, α-hydroxyoctadecyl phosphonic acid, α-hydroxyeicosyl phosphonic acid, α-hydroxydocosyl phosphonic acid, and α-hydroxytetracosyl phosphonic acid.

As the metallic salt of mercaptoacetic acid for use in the color developer, alkyl mercaptoacetic acid or alkenyl mercaptoacetic acid represented by the following general formula (IX) can be employed:

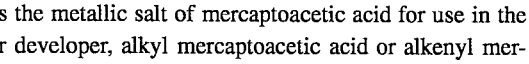

(IX)

wherein $R^{12}$ represents an aliphatic group having 10 to 18 carbon atoms; and M represents tin, magnesium, zinc, or copper.

Specific examples of the metallic salt of the mercaptoacetic acid represented by general formula (IX) are as follows: tin decylmercaptoacetate, tin dodecylmercaptoacetate, tin tetradecylmercaptoacetate, tin hexadecylmercaptoacetate, tin octadecylmercaptoacetate, magnesium decylmercaptoacetate, magnesium dodecylmercaptoacetate, magnesium tetradecylmercaptoacetate, magnesium hexadecylmercaptoacetate, magnesium octadecylmercaptoacetate, zinc decylmercaptoacetate, zinc dodecylmercaptoacetate, zinc tetradecylmercaptoacetate, zinc hexadecylmercaptoacetate, zinc octadecylmercaptoacetate, copper decylmercaptoacetate, copper dodecylmercaptoacetate, copper tetradecylmercaptoacetate, copper hexadecylmercaptoacetate, and copper octadecylmercaptoacetate.

The reversible thermosensitive coloring composition of the present invention comprises as the main components the above-mentioned color developer and the coloring agent. As the coloring agent for use in the present invention, the following electron-donor compounds can be employed. These coloring agents are colorless or light-colored before the color formation is induced therein. Examples of such compounds are conventionally known triphenylmethane phthalide compounds, fluoran compounds, phenothiazine compounds, leuco auramine compounds and indolinophthalide compounds.

As preferable coloring agents for use in the present invention, a fluoran compounds represented by the following general formula (X) can be employed:

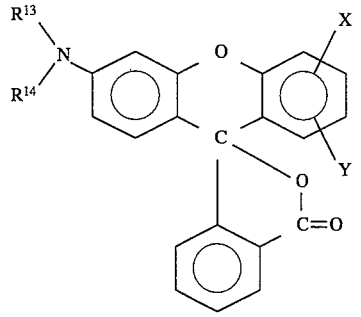

(X)

wherein $R^{13}$ represents hydrogen, an alkyl group, an allyl group, a cyclic alkyl group or an alkoxyalkyl group, $R^{14}$ represents an alkyl group, a cyclic alkyl group, an allyl group, an alkoxylalkyl group or a phenyl group which may have a substituent; X represents hydrogen, a lower alkyl group, a lower alkoxyl group, an alkoxylalkyl group, or halogen; and Y represents a lower alkyl group, an amino group, a substituted amino group, a cyano group or halogen.

Specific examples of the fluoran compound represented by general formula (X) are as follows:

2-anilino-3-methyl-6-(N-n-hexyl-N-iso-amylamino)fluoran,
2-anilino-3-methyl-6-(di-n-hexylamino)fluoran,
2-anilino-3-methyl-6-(di-n-amylamino)fluoran,
2-anilino-3-methyl-6-(di-n-octylamino)fluoran,
2-anilino-3-methyl-6-(di-n-butylamino)fluoran,
2-anilino-3-methyl-6-(N-isopropyl-N-methylamino)fluoran,
2-anilino-3-methyl-6-(N-n-octyl-N-ethylamino)fluoran,
2-anilino-3-methyl-6-(N-n-octyl-N-iso-propylamino)fluoran,
2-anilino-3-methyl-6-(N-n-amyl-N-n-propylamino)fluoran,
2-anilino-3-methyl-6-(N-n-amyl-N-n-butylamino)fluoran,
2-anilino-3-methyl-6--(N-n-amyl-N-ethylamino)fluoran,
2-anilino-3-methyl-6-(N-n-amyl-N-methylamino)fluoran,
2-anilino-3-methyl-6-(N-iso-amyl-N-ethylamino)fluoran,
2-anilino-3-methyl-6-(N-n-propyl-N-isopropylamino)fluoran,
2-anilino-3-methyl-6-(N-n-butyl-N-n-propylamino)fluoran,
2-anilino-3-methyl-6-(N-ethyl-N-sec-butylamino)fluoran,
2-anilino-3-methyl-6-(N-n-butyl-N-iso-propylamino)fluoran,
2-anilino-3-methyl-6-(N-n-butyl-N-ethylamino)fluoran,
2-anilino-3-methyl-6-(N-isobutyl-N-methylamino)fluoran,
2-anilino-3-methyl-6-(N-cyclohexyl-N-n-tetradecylamino)fluoran,
2-anilino-3-methyl-6-(N-cyclohexyl-N-n-dodecylamino)fluoran,
2-anilino-3-methyl-6-(N-cyclohexyl-N-n-decylamino)fluoran,
2-anilino-3-methyl-6-(N-cyclohexyl-N-n-octylamino)fluoran,
2-anilino-3-methyl-6-(N-cyclohexyl-N-n-hexylamino)fluoran,
2-anilino-3-methyl-6-(N-cyclohexyl-N-n-amylamino)fluoran,
2-anilino-3-methyl-6-(N-cyclohexyl-N-iso-amylamino)fluoran,
2-anilino-3-methyl-6-(N-cyclohexyl-N-n-butylamino)fluoran,
2-anilino-3-methyl-6-(N-cyclohexyl-N-n-propylamino)fluoran,
2-anilino-3-methyl-6-(N-cyclohexyl-N-ethylamino)fluoran,
2-anilino-3-methyl-6-(N-cyclohexyl-N-methylamino)fluoran,
2-anilino-3-methyl-6-(dicyclohexylethylamino)fluoran,
2-anilino-3-methyl-6-(N-cyclohexylethyl-N-n-hexylamino)fluoran,
2-anilino-3-methyl-6-(N-cyclohexylethyl-N-n-amylamino)fluoran,
2-anilino-3-methyl-6-(dicyclohexylmethylamino)fluoran,
2-anilino-3-methyl-6-(N-cyclohexylmethyl-N-n-hexylamino)fluoran,
2-anilino-3-methyl-6-(N-cyclohexylmethyl-N-n-amylamino)fluoran,
2-anilino-3-methyl-6-(N-cyclohexylmethyl-N-n-butylamino)fluoran,
2-anilino-3-methyl-6-(N-cyclohexylmethyl-N-cyclohexylamino)fluoran,
2-anilino-3-methyl-6-(diallylamino)fluoran,
2-anilino-3-methyl-6-(N-n-octyl-N-allylamino)fluoran,
2-anilino-3-methyl-6-(N-n-hexyl-N-allylamino)fluoran,
2-anilino-3-methyl-6-(N-n-amyl-N-allylamino)fluoran,
2-anilino-3-methyl-6-(N-ethyl-N-allylamino)fluoran,
2-anilino-3-methyl-6-(N-2-ethoxypropyl-N-ethylamino)fluoran,
2-anilino-3-methyl-6-(diethoxyethylamino)fluoran,
2-anilino-3-methyl-6-(N-ethoxyethyl-N-n-hexlamino)fluoran,
2-anilino-3-methyl-6-(N-ethoxyethyl-N-n-amylamino)fluoran,
2-anilino-3-methyl-6-(N-ethoxyethyl-N-iso-amylamino)fluoran,
2-anilino-3-methyl-6-(N-ethoxyethyl-N-n-butylamino)fluoran,
2-anilino-3-methyl-6-(N-ethoxyethyl-N-ethylamino)fluoran,
2-anilino-3-methyl-6-(N-ethoxymethyl-N-n-hexylamino)fluoran,
2-anilino-3-methyl-6-(N-ethoxymethyl-N-n-amylamino)fluoran,
2-anilino-3-methyl-6-(N-ethoxymethyl-N-iso-amylamino)fluoran,
2-anilino-3-methyl-6-(N-n-hexadecylamino)fluoran,
2-anilino-3-methyl-6-(N-n-octylamino)fluoran,
2-anilino-3-methyl-6-(N-n-hexylamino)fluoran,
2-anilino-3-methyl-6-(N-ethyl-p-toluidino)fluoran,
2-anilino-3-methyl-6-(N-methyl-p-toluidino)fluoran,
2-anilino-3-methoxy-6-(di-n-hexylamino)fluoran,
2-anilino-3-methoxy-6-(di-n-amylamino)fluoran,
2-anilino-3-methoxy-6-(N-n-hexyl-N-iso-amylamino)fluoran,
2-anilino-3-methoxy-6-(N-cyclohexyl-N-n-hexylamino)fluoran,
2-anilino-3-ethoxy-6-(di-n-amylamino)fluoran,
2-anilino-3-ethoxy-6-(di-n-butylamino)fluoran,
2-anilino-3-ethoxy-6-diethylaminofluoran,
2-anilino-3-ethoxy-6-(N-cyclohexyl-N-n-hexylamino)fluoran,
2-anilino-3-ethoxy-6-(N-cyclohexyl-N-n-amylamino)fluoran,
2-anilino-3-ethoxyethyl-6-(di-n-amylamino)fluoran,
2-anilino-3-ethoxyethyl-6-(di-n-butylamino)fluoran,
2-anilino-3-ethoxyethyl-6-diethylaminofluoran,
2-anilino-3-ethoxymethyl-6-(di-n-butylamino)fluoran,
2-anilino-3-ethoxymethyl-6-(N-cyclohexyl-N-n-hexylamino)fluoran,
2-anilino-3-ethoxymethyl-6-(di-n-amylamino)fluoran,
2-anilino-3-methoxymethyl-6-(N-cyclohexyl-N-n-hexylamino)fluoran,
2-benzylamino-3-methyl-6-(di-n-butylamino)fluoran,
2-benzylamino-3-methyl-6-(di-n-amylamino)fluoran,
2-benzylamino-3-methyl-6-(N-cyclohexyl-N-n-hexylamino)fluoran,
2-(m-trichloromethylanilino)-3-methyl-6-diethylaminofluoran, 2-(m-trifluoromethylanilino)-3-methyl-6-diethylaminofluoran,
2-(m-trifluoromethylanilino)-3-methyl-6-(N-cyclohexyl-N-methylamino)fluoran,
2-(2,4-dimethylanilino)-3-methyl-6-(N-n-hexyl-N-iso-amylamino)fluoran,
2-(2,4-dimethylanilino)-3-methyl-6-(di-n-hexylamino)fluoran,
2-(2,4-dimethylanilino)-3-methyl-6-(di-n-amylamino)fluoran,
2-(2,4-dimethylanilino)-3-methyl-6-(di-n-butylamino)fluoran,
2-(2,4-dimethylanilino)-3-methyl-6-diethylaminofluoran,
2-(N-ethyl-p-toluidino)-3-methyl-6-(N-ethylanilino)fluoran,
2-(N-methyl-p-toluidino)-3-methyl-6-(N-propyl-p-toluidino)fluoran,
2-anilino-6-(di-n-hexylamino)fluoran,
2-anilino-6-(N-n-hexyl-N-iso-amylamino)fluoran,
2-anilino-6-(di-n-amylamino)fluoran,
2-anilino-6-diethylaminofluoran,
2-anilino-6-(N-n-hexyl-N-ethylamino)fluoran,
2-anilino-6-(N-cyclohexyl-N-n-hexylamino)fluoran,
2-anilino-6-(N-cyclohexyl-N-n-amylamino)fluoran,
2-anilino-6-(N-cyclohexyl-N-methylamino)fluoran,
2-anilino-6-(diethoxyethylamino)fluoran,
2-anilino-6-(N-ethoxyethyl-N-iso-amylamino)fluoran,
2-anilino-6-(N-ethoxyethyl-N-n-amylamino)fluoran,
2-anilino-6-(N-ethyoxyethyl-N-n-butylamino)fluoran,
2-anilino-6-(N-n-octylamino)fluoran,
2-anilino-6-(N-n-hexylamino)fluoran,
2-anilino-6-(N-n-amylamino)fluoran,
2-(N-methylanilino)-6-(N-ethyl-p-toluidino)fluoran,
2-(o-chloroanilino)-6-diethylaminofluoran,
2-(o-bromoanilino)-6-diethylaminofluoran,
2-(o-chloroanilino)-6-dibutylaminofluoran,
2-(o-fluoroanilino)-6-dibutylaminofluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-(m-trifluoromethylanilino)-6-diethylaminofluoran,
2-(p-acetylanilino)-6-diethylaminofluoran,
2-(p-acetylanilino)-6-(N-n-hexyl-N-iso-hexylamino)fluoran,
2-(p-acetylanilino)-6-(di-n-hexylamino)fluoran,
2-(p-acetylanilino)-6-(N-n-hexyl-N-n-amylamino)fluoran,
2-(p-acetylanilino)-6-(di-n-amylamino)fluoran,
2-(p-acetylanilino)-6-(N-n-amyl-N-n-butylamino)fluoran,
2-(p-acetylanilino)-6-(N-cyclohexyl-N-n-hexylamino)fluoran,
2-(p-acetylanilino)-6-(N-ethoxyethyl-N-iso-amylamino)fluoran,
2-(p-acetylanilino)-6-(N-ethoxyethyl-N-n-amylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-benzoylamino-6-(N-ethyl-p-toluidino)fluoran,
2-(o-methoxybenzoylamino)-6-(N-methyl-p-toluidino)fluoran,
2-dibenzylamino-6-(di-n-butylamino)fluoran,
2-dibenzylamino-6-(di-n-amylamino)fluoran,
2-dibenzylamino-6-(di-n-hexylamino)fluoran,
2-dibenzylamino-6-(N-n-hexyl-N-iso-amylamino)fluoran,
2-dibenzylamino-6-(di-n-propylamino)fluoran,
2-dibenzylamino-6-(N-cyclohexyl-N-n-amylamino)fluoran,
2-dibenzylamino-6-(N-cyclohexyl-N-n-hexylamino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino)fluoran,
2-dibenzylamino-4-methyl-6-diethylaminofluoran,
2-dibenzylamino-4-methyl-6-(di-n-propylamino)fluoran,
2-dibenzylamino-4-methyl-6-(di-n-butylamino)fluoran,
2-dibenzylamino-4-methyl-6-(di-n-amylamino)fluoran,
2-dibenzylamino-4-methoxy-6-(N-methyl-p-toluidino)fluoran,
2-benzylamino-4-methyl-6-(N-ethyl-p-toluidino)fluoran,
2-(α-phenylethylamino)-4-methyl-6-diethylaminofluoran,
2-(p-toluidino)-3-(t-butyl)-6-(N-methyl-p-toluidino)fluoran,
2-(α-phenylethylamino)-6-(N-ethyl-p-toluidino)fluoran,
2-(o-methoxycarbonylanilino)-6-diethylaminofluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-ethylamino-6-(N-ethyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-acetylamino-3-methyl-6-diethylaminofluoran,
2-acetylamino-3-methyl-6-(di-n-butylamino)fluoran,
2-acetylamino-3-methyl-6-(di-n-amylamino)fluoran,
2-acetylamino-3-methyl-6-(di-n-hexylamino)fluoran,
2-acetylamino-6-(N-methyl-p-toluidino)fluoran,
2-amino-6-diethylaminofluoran,
2-amino-6-(di-n-butylamino)fluoran,
2-amino-6-(di-n-amylamino)fluoran,
2-amino-6-(di-n-hexylamino)fluoran,
2-amino-6-(N-cyclohexyl-N-n-amylamino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2-amino-3-methyl-6-diethylaminofluoran,
2-amino-3-methyl-6-(di-n-butylamino)fluoran,
2-amino-3-methyl-6-(di-n-amylamino)fluoran,
2-amino-3-methyl-6-(di-n-hexylamino)fluoran,
2-amino-3-methoxy-6-(di-n-butylamino)fluoran,
2-amino-3-methoxy-6-(di-n-amylamino)fluoran,
2-amino-3-methoxy-6-(di-n-hexylamino)fluoran,
1,3-dimethyl-6-diethylaminofluoran,
1,3-dimethyl-6-(di-n-butylamino)fluoran,
1,3-dimethyl-6-(di-n-amylamino)fluoran,
1,3-dimethyl-6-(di-n-hexylamino)fluoran,
1,3-dimethyl-6-(N-cyclohexyl-N-n-butylamino)fluoran,
2,3-dimethyl-6-dimethylaminofluoran,
2-methyl-6-dimethylaminofluoran, 2-methyl-6-diethylaminofluoran,
2-methyl-6-(di-n-propylamino)fluoran,
2-methyl-6-(di-n-butylamino)fluoran,
2-methyl-6-(di-n-amylamino)fluoran,
2-methyl-6-(di-n-hexylamino)fluoran,
2-methyl-6-(N-cyclohexyl-N-n-amylamino)fluoran,
2-methyl-6-(N-cyclohexyl-N-methylamino)fluoran,
3-diethylamino-6-(m-trifluoromethylanilino)fluoran,
3-methyl-6-(N-ethyl-p-toluidino)fluoran,
2-methyl-6-(N-ethyl-p-toluidino)fluoran,
4-methoxy-6-(N-ethyl-p-toluidino)fluoran,
2-cyano-6-diethylaminofluoran,
2-cyano-6-(di-n-butylamino)fluoran,
2-cyano-6-(di-n-amylamino)fluoran,
2-cyano-6-(di-n-hexylamino)fluoran,
2-cyano-6-(N-cyclohexyl-N-n-hexylamino)fluoran,
2-cyano-6-(N-cyclohexyl-N-n-decylamino)fluoran,
2-chloro-6-diethylaminofluoran,
2-bromo-6-diethylaminofluoran,
2-chloro-6-dipropylaminofluoran,
2-chloro-6-dibutylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
2-ethoxyethylamino-3-chloro-6-dibutylaminofluoran,
2-benzylamino-4-chloro-6-(N-ethyl-p-toluidino)fluoran,
2-dibenzylamino-4-chloro-6-(N-ethyl-p-toluidino)fluoran,
2-(α-phenylethylamino)-4-chloro-6-diethylaminofluoran, and
2-(N-benzyl-p-trifluoromethylanilino)-4-chloro-6-diethylaminofluoran.

Specific examples of fluoran compounds used as the coloring agent other than the fluoran compound represented by general formula (X) are as follows:

2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino)fluoran,
2-mesidino-3-methyl-4',5'-benzo-6-diethylaminofluoran,
2-(m-trifluoromethylanilino)-3-methyl-6-pyrrolidinofluoran,
2-(αnaphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholinofluoran,
2-(di-N-p-chlorophenyl-methylamino)-6-pyrrolidinofluoran,
2-(N-n-propyl-m-trifluoromethylanilino)-6-morpholinofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(di-n-amylamino)fluoran,
1,2-benzo-6-(di-n-hexylamino)fluoran,
1,2-benzo-6-(N-methyl-N-cyclohexylamino)fluoran,
1,2-benzo-6-(N-ethyl-N-n-octylamino)fluoran,
1,2-benzo-6-(N-ethyl-p-toluidino)fluoran,
1,2-benzo-6-diallylaminofluoran, and
1,2-benzo-6-(N-ethoxyethyl-N-ethylamino)fluoran.

Specific examples of compounds other than the fluoran compounds, which are preferably employed as the coloring agent in the present invention, are as follows:

benzoleuco methylene blue,
2-[3,6-bis(diethylamino)]-6-(o-chloroanilino)xanthyl benzoic acid lactam,
2-[3,6-bis(diethylamino)]-9-(o-chloroanilino)xanthyl benzoic acid lactam,
3,3-bis(p-dimethylaminophenyl)-phthalide,
3,3-bis(p-dimethylaminophenyl)-6-dimethylaminophthalide (or Crystal Violet Lactone)
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethyoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3-(2-methoxy-4-dimethylaminophenyl)-3-(2-hydroxy-4-chloro-5-methoxyphenyl)phthalide,
3,6-bis(dimethylamino)fluorenespiro(9,3')-6'-dimethylaminophthalide,
6'-chloro-8'-methoxy-benzoindolino-spiropyran, and
6'-bromo-2'-methoxy-benzoindolino-spiropyran.

It is necessary to use the coloring agent and the color developer in an appropriate ratio in accordance with the properties of the compounds employed. It is preferable that the molar ratio of the coloring agent to the color developer be in the range of (1:1) to (1:20), and more preferably in the range of (1:2) to (1:10), to obtain an appropriate color density for use in practice. The color developers and the coloring agents for use in the present invention can be used alone or in combination.

When the amount of the color developer is larger than that of the coloring agent, the decolorization initiation temperature tends to be lowered, while when the amount of the color developer is smaller than that of the coloring agent, the decolorization becomes sensitive to the changes in the temperature. Therefore, the ratio of the coloring agent to the color developer should be decided, with the usage and the purpose thereof taken into consideration.

Additives for controlling the crystallization of the color developer can be add to the reversible thermosensitive coloring composition for improving its properties such as decolorizing properties and the preservability thereof.

As mentioned previously, the reversible thermosensitive coloring recording medium according to the present invention may comprise a plurality of coloring composition layers and intermediate layers made of a resin in such a fashion that each of the intermediate layers is interposed between the coloring composition layers.

By the provision of the intermediate layers, each of the coloring composition layers can be prevented from being fused and bonded to each other.

Any materials which can support the recording layer thereon can be employed as the materials for the support. For example, paper, synthetic paper, a plastic film, a composite film of the paper and the plastic film, and a glass plate can be employed.

The recording layer can be in any form as long as the reversible thermosensitive coloring composition can be contained therein. For instance, a reversible thermosensitive coloring recording layer can be obtained by mixing and fusing the coloring agent and the color developer to make the mixture into a film, followed by cooling. It is preferable that the recording layer be obtained by thoroughly dispersing the color developer and the coloring agent in a binder resin, so that a long life reversible thermosensitive coloring recording medium can be obtained.

As the binder resin, for example, hydroxyethyl cellulose, hydroxypropyl cellulose, methoxy cellulose, carboxymethyl cellulose, methyl cellulose, cellulose acetate, gelatin, casein, starch, sodium polyacrylate, polyvinyl pyrrolidone, polyacrylamide, polyvinyl chloride, polyvinyl acetate, vinyl chloride - vinyl acetate copolymer, polystyrene, styrene copolymer, phenoxy resin, polyester, aromatic polyester, polyurethane, polycarbonate, polyacrylic acid ester, polymethacrylic acid ester, acrylic acid copolymer, maleic acid copolymer, polyvinyl alcohol, chlorinated vinyl chloride, and mixtures of the above binder resins can be employed.

Moreover, it is possible that each of the reversible thermosensitive coloring compositions which comprises the color developer and the coloring agent is microcapsuled. The reversible thermosensitive coloring compositions can be microcapsuled by a conventional method such as the coacervation method, the interfacial polymerization method, or the in-situ polymerization method.

The recording layer can be formed by a conventional method. More specifically, a coloring agent and a color developer are uniformly dispersed or dissolved in water or in an organic solvent, together with a binder resin to prepare a coating liquid. The thus prepared coating liquid is coated on the support or the intermediate layer and dried, whereby a recording layer is formed.

The binder resin employed in the recording layer serves to maintain the reversible thermosensitive coloring composition in a uniformly dispersed state in the recording layer even when the color development and the decolorization are repeated. It is preferable that the binder resin have high heat resistance. This is because if the binder resin does not have high heat resistance, the reversible thermo-sensitive coloring composition is caused to coagulate and the presence thereof becomes non-uniform during the application of heat for the color development of the recording layer.

In the reversible thermosensitive coloring recording medium according to the present invention, when necessary, a variety of additives employed in conventional thermosensitive recording paper, such as dispersing agent, surface active agent, polymeric cationic electroconductive agent, filler, colored-image-stabilizing agent, antioxidant, light stabilizer, and lubricant may be added to the recording layer coating liquid in order to improve the coating properties of the coating liquid and the recording properties of the recording layer.

The intermediate layer for use in the present invention serves as a separating layer which prevents the adjacent coloring composition layers from being mixed under the application of heat and pressure thereto during color development and decolorization.

When the coloring composition layers for use in the present invention comprise the same resin as a binder resin, the coloring composition layers which are in contact with each other tend to be partially mixed by the application of heat and pressure thereto. The above-mentioned problem can also be solved by the provision of the above-mentioned intermediate layers.

It is preferable that the intermediate layer be superimposed on the coloring composition layer by a dry lamination method, with the color formation properties of the recording medium and the image preservability thereof taken into consideration.

In the present invention, the thickness of the intermediate layer may be such that the intermediate layer is not damaged even by the application of heat and pressure during repeated image formation and erasure. However, when the intermediate layer is too thick the thermal conductivity thereof is decreased, so that it is preferable that the thickness of the intermediate layer be 10 μm or less.

The intermediate layer can be made of a polyester film such as a polyethylene terephthalate film. In addition to the above, a film of polyamide, polyimide, polyamide-imide, or polyparabanic acid can be preferably used.

For adhering the resin film employed as the intermediate layer to the coloring composition layer, any adhesive agents that can be used in the dry lamination method can be employed in the present invention. Specific examples of the adhesive agent are thermoplastic resins such as ionomer resin, acrylic resin including an aqueous emulsion of acrylic resin, modified ethylene-vinyl acetate copolymer, polybutadiene, phenoxy resin, polyvinyl ether, polyvinyl formal, vinyl acetate resin, and polyester resin; and thermosetting resins such as urethane resin, epoxy resin, xylene resin, phenolic resin, and urea resin.

A protective layer may be formed on the top surface of the reversible thermosensitive coloring recording medium according to the present invention. The provision of the protective layer has the effect for preventing the deformation of the surface of the recording medium and the discoloration thereof caused by the application of heat and pressure thereto. The protective layer also has the function of improving the chemical resistance, water resistance, abrasion resistance, and head matching properties of the reversible thermosensitive coloring recording medium.

As a material for forming the protective layer for use in the present invention, it is desirable to employ a resin film with excellent heat resistance and strength. Specific examples of the resin film include polyamide film, polyimide film, aromatic polyester film, and polyparabanic acid film. By providing such a protective layer, the resistance to organic solvents, oils, sweat and water of the reversible thermosensitive coloring recording medium can be improved, so that a reversible thermosensitive coloring recording medium which is not affected by the repetition of image formation and erasure, even when image formation and erasure, even when image formation and erasure are conducted under adverse conditions, can be obtained.

By containing a light stabilizer in the protective layer, a recording medium with an improved light-resistance of the image and the background can be obtained. The addition of a polymeric cationic electroconductive agent to the protective layer imparts an antistatic effect to the recording medium.

Furthermore, by containing an organic or inorganic filler, or a lubricant in the protective layer, a reversible thermosensitive coloring recording medium which is free from the sticking problem caused by use of a thermal head and has high reliability and head matching properties can be obtained.

When necessary, an undercoat layer may be interposed between the support and the recording layer, with the specific properties of the support taken into consideration. The undercoat layer is provided to improve the adhesion properties between the support and the recording layer, the resistance to solvents of the support when the recording layer is formed on the support, and the thermofusible ink-absorption-prevention effect of the support when heat is applied to the recording medium.

One of the other important roles of the undercoat layer is to improve the insulation effect of the recording medium by which applied energy to the recording medium can be effectively utilized for the image formation and erasure. By the provision of the undercoat layer which serves as a heat insulating layer, sharp image formation and erasure can be attained. For forming the undercoat layer for the purpose of improving the insulation effect, it is preferable to coat an undercoat layer coating liquid comprising minute void particles of an organic or inorganic material on the support. More specifically, a coating liquid prepared by thoroughly dispersing void particles made of glass, ceramic, or plastics, with a particle diameter in the range of 10 to 50 μm together with a binder resin in a solvent, is uniformly coated on the support and dried, so that an undercoat layer with an improved heat insulation effect can be obtained.

The reversible thermosensitive coloring recording medium according to the present invention can be fabricated in accordance with various manufacturing procedures. For instance, a coloring composition layer A is formed on a support by coating. A first intermediate layer comprising a resin film with an adhesive agent is then laminated on the coloring composition layer A. A coloring composition layer B is overlaid on the first intermediate layer, and then a second intermediate layer comprising a resin film is laminated on the coloring composition layer B.

In the lamination method, laminated layers are firmly adhered to each other by the application of heat and pressure thereto by use of an apparatus such as a heat-application roller. Alternatively, the heat and pressure maybe applied to the laminated layers after all the layers constituting the recording medium are laminated, or whenever one of the intermediate layers is formed on each coloring composition layer.

When a transparent film is employed as a support, a transparent recording medium can be obtained in the present invention, which can be preferably employed as a display medium. In this case, it is preferable that the transparency of each of the films employed as the resin layer and the protective layer be high.

In order to produce multi-color images on the recording medium, heat must be imagewise applied to the same portion of the recording medium multiple times, although the heat application means for this heat application is not limited to a particular heating element, but a heating pen, a thermal head and a laser-application heating element can be employed.

In order to erase recorded images, heat must be applied multiple times to the same portion of the recording medium as that corresponding to the recorded image as the temperature of the heat is changed in accordance with the respective decolorization temperatures.

Means for performing the above decolorization is not limited to a particular device as long as it can heat the recording medium under the conditions required for the decolorization. For this purpose, a heat-application roller, plate-shaped heat generating means, a temperature-controlled chamber, warm air application means, and a thermal head can be employed.

It is also possible to perform overwriting, which is conducted by use of a plurality of thermal heads, each adjusted to heat the recording medium at a predetermined temperature for image formation, and simultaneously by use of a plurality of thermal heads, each adjusted to heat the recording medium at a predetermined temperature for image erasure.

In the present invention, as mentioned above, it is necessary to apply heat energy multiple times to the recording medium at the same portion thereof to obtain a multi-color image on the reversible thermosensitive coloring recording medium. Therefore, it is desired to shorten the multi-color image formation period. For this purpose, the following image formation apparatus is provided in the present invention.

In order to obtain a multi-color image on a reversible thermosensitive coloring recording medium of the present invention, all the necessary coloring composition layers have to be colored by the application of heat thereto, followed by the erasure of unnecessary colors with the application of heat thereto. For instance, in order to obtain a multi-color image on a reversible thermosensitive coloring recording medium comprising three coloring composition layers as described in Table 2, it is necessary to perform heat application three times.

In the case where an image formation apparatus includes, for example, only one heat generating means, a long period of time is required for multi-color image formation. To eliminate this shortcoming, a plurality of heat generating means, which are continuously brought into contact with the reversible thermosensitive coloring recording medium, are provided in an image formation apparatus, and the temperatures of the heat generating means are respectively set at a temperature at which all the coloring composition layers assume the color development state, or at the decolorization temperature of any of the coloring composition layers. Thus, the time required for the multi-color image formation can be significantly shortened.

A recording apparatus for producing multi-color images by use of the reversible thermosensitive recording medium, according to the present invention comprises (a) first heat generating means for applying heat imagewise to the recording medium to the color development temperature range of any of the reversible thermosensitive coloring compositions, (b) second heat generating means for applying heat imagewise to the recording medium to the decolorization temperature range of any of the reversible thermosensitive coloring compositions, and (c) third heat generating means for applying heat to the entire surface of the recording medium to the decolorization temperature range of each of the reversible thermosensitive coloring compositions.

Figure 6:
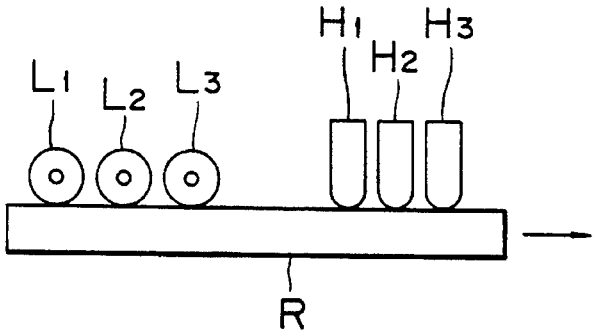
FIG. 6 is a diagram showing the basic structure of a recording apparatus used with a reversible thermosensitive coloring recording medium according to the present invention.

FIG. 6 is a diagram showing the basic structure of a recording apparatus used with a reversible thermosensitive coloring recording medium according to the present invention comprising three coloring composition layers. In FIG. 6, reference symbols $L_1$, $L_2$, and $L_3$ indicate heat generating means for decolorizing the coloring composition layers in the respective entireties in the color development state, and reference symbols $H_1$, $H_2$, and $H_3$, indicate heat generating means for image recording.

The reversible thermosensitive coloring recording medium is transported in the direction of the arrow shown in FIG. 6.

In the case where each of the decolorization temperature ranges of the three coloring composition layers is determined as shown by the arrows in FIGS. 4(*a*), 4(*b*) and 4(*c*), the heat generating means $L_1$, $L_2$, and $L_3$ for decolorizing the respective coloring composition layers in the color development state are successively adjusted to temporarily heat the coloring composition layers to temperatures $T_2$, $T_3$, and $T_4$. Therefore, a multi-color image formed on the recording medium can be decolorized to obtain all the coloring composition layers in the decolorization state by causing the recording medium to pass over the heat generating means $L_1$, $L_2$, and $L_3$ for decolorizing. Subsequently, the reversible thermosensitive coloring recording medium is caused to pass over the heat generating means $H_1$, $H_2$, and $H_3$ for image formation by which thermal energy can be applied imagewise to the recording medium. More specifically, heat generating means $H_1$ for color development is adjusted to generate heat which is temporarily applied imagewise to the recording medium at temperature $T_1$, $T_2$ or $T_3$, when necessary. Heat generating means $H_2$ and $H_3$ generate heat which is applied to the coloring composition layers imagewise respectively to temperatures $T_3$ and $T_4$ when necessary, and decolorize unnecessary color portions of the coloring composition layer, formed by the heat generating means $H_1$ for image formation.

For instance, when only the color of the coloring composition layer C shown in FIG. 4(*c*) is necessary in a portion of a multi-color image, the heat generating means $H_1$, $H_2$ and $H_3$ for image formation are respectively adjusted to generate heat at temperatures $T_1$, $T_3$ and $T_4$. When the recording medium is caused to pass over the heat generating means $H_1$, all the coloring composition layers A, B and C are colored. When the above recording medium comprising the coloring composition layers A, B and C in the mixed coloring state is caused to pass over the heat generating means $H_2$, the color of the coloring composition layer B is decolorized, and when the recording medium is caused to pass over the heat generating means $H_3$, the color of the coloring composition layer A is decolorized. As a result, the color of the coloring composition layer C is obtained in the portion of the multi-color image.

As the heat generating means $H_1$, $H_2$ and $H_3$ for image formation by which heat is applied imagewise to the recording medium, conventionally employed thermal heads for thermal recording can be used, and as the heat generating means $L_1$, $L_2$ and $L_3$ for decolorizing the coloring composition layers in their entireties, heat-application rollers or thermal heads can be employed.

Furthermore, the heat generating means $H_1$, $H_2$ and $H_3$ for image formation can also be employed for decolorizing each of the coloring composition layers on the entire surface thereof. In this case, it is not necessary to provide the heat generating means $L_1$, $L_2$ and $L_3$ for decolorizing.

When the reversible thermosensitive coloring recording medium according to the present invention comprises a irreversible coloring composition layer, image formation and erasure can be repeatedly performed effectively in all the coloring composition layers except the irreversible coloring composition layer by using the recording apparatus used for the reversible thermosensitive coloring recording medium according to the present invention. In this case, the entire recording medium cannot assume the initial decolorization state. The image formation and erasure can be performed only in consideration of the coloring composition layers which reversibly perform the image formation and erasure.

Figure 7A:
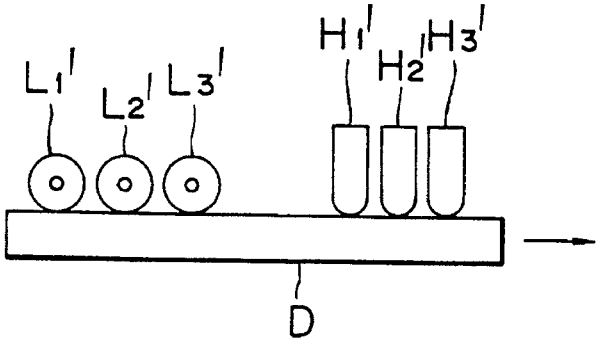
FIGS. 7(*a*) is a diagram showing the basic structure of a recording apparatus used with a reversible thermosensitive coloring recording medium according to the present invention, which is employed as a sheet-shaped display medium.
Figure 7B:
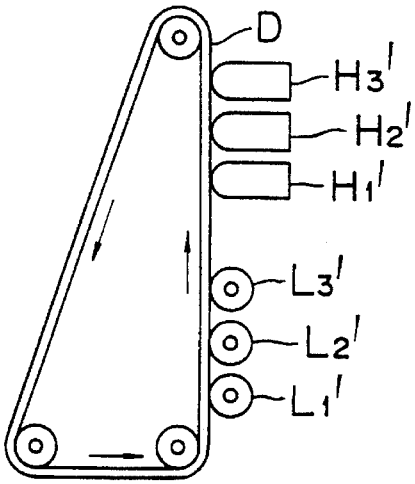

FIGS. 7(*a*) and 7(*b*) are diagrams showing preferable examples of the basic structures of the recording apparatuses used for the multi-color image formation and erasure by use of the reversible thermosensitive coloring recording medium according to the present invention which can be effectively used as an display medium.

In FIG. 7(*a*), a sheet-shaped display medium D is in contact with heat generating means $L_1'$, $L_2'$ and $L_3'$ for totally decolorizing the coloring composition layers and is in contact with heat generating means $H_1'$, $H_2'$ and $H_3'$ for image formation. Heat is applied to the sheet-shaped display medium D, which is moved in the direction of the arrow shown in FIG. 7(*a*) and the display medium D is decolorized by the heat generating means $L_1'$, $L_2'$ and $L_3'$ for totally decolorizing the coloring composition layers, or caused to develop color by the heat generating means $H_1'$, $H_2'$ and $H_3'$ for image formation. Alternatively, it is possible to employ a fixed reversible thermosensitive coloring recording medium and movable heat generating means.

In FIG. 7(*b*), heat generating means $L_1'$, $L_2'$ and $L_3'$ for totally decolorizing the coloring composition layers, and heat generating means $H_1'$, $H_2'$ and $H_3'$ for image formation are provided in contact with an endless belt-shaped display medium D.

The recording apparatus of the present invention is also employed for initializing the reversible thermosensitive coloring recording medium.

When the reversible thermosensitive coloring recording medium, employed as the display medium D, comprising three coloring composition layers with the decolorization temperature ranges shown by the arrows in FIG. 4(*a*), 4(*b*) and 4(*c*) passes over the heat generating means $L_1'$, $L_2'$ and $L_3'$ for decolorizing each of the coloring composition layers on the entire surface thereof set to temporarily generate heat respectively at temperatures $T_2$, $T_3$ and $T_4$ in turn, the multi-color image formed on the display medium D are decolorized since all of the three coloring composition layers assume the decolorization state, thereby the display medium assumes the initial decolorization state.

Subsequently, the display medium D in the initial decolorization state is caused to pass over the heat generating means $H_1'$, $H_2'$ and $H_3'$ for image formation by which heat energy is applied imagewise to the display medium D. The heat generating means $H_1'$ for image formation is adjusted to generate heat at a temperature $T_1$, $T_2$ or $T_3$ temporarily applied imagewise to the coloring composition layers when necessary. Moreover, the heat generating means $H_2'$ and $H_3'$ are adjusted to generate heat respectively at temperatures $T_3$ and $T_4$ applied imagewise to the display medium D.

Among the produced colors of the coloring composition layers obtained when the recording medium is passed over the heat generating means $H_1'$, unnecessary color portions are decolorized. More specifically, in the case where only the color of the coloring composition layer C shown in FIG. 4(*c*) is necessary at a portion of a multi-color image to be obtained, the heat generating means $H_1'$, $H_2'$ and $H_3'$ are adjusted to generate heat respectively at temperatures $T_1$, $T_3$ and $T_4$. When the display medium D is passed over the heat generating mean $H_1$, all of the coloring composition layers A, B and C assume the color development state. Subsequently, when the display medium D is passed over the heat generating means $H_2'$, the coloring composition layer B is decolorized, and then, when the recording medium is passed over the heat generating means $H_3'$, the coloring composition layer A is decolorized. Thus, the coloring composition layer C can be colored in a portion of the multi-color image. The heat generating means $L_1'$, $L_2'$ and $L_3'$ for decolorizing the coloring composition layers in their entireties and the heat generating means $H_1'$, $H_2'$ and $H_3'$ for image formation are the same as that mentioned previously used for the reversible thermosensitive coloring recording medium as shown in FIG. 6. When the reversible thermosensitive coloring recording medium of the present invention is employed as the display medium comprising an irreversible coloring composition layer the image formation and erasure can also be performed in the same manner as mentioned above.

Other features of this invention will become apparent in the course of the following description of exemplary embodiments which are given for illustration of the invention and are not intended to be limiting thereof.

EXAMPLE 1

The following color developer and coloring agent were mixed at a molar ratio of 2:1 and the mixture thus obtained was thoroughly pulverized, so that reversible thermosensitive coloring compositions A-1 and B-2 were separately prepared:

[Coloring composition A-1]

Color developer: tetradecyl phosphonic acid

Coloring agent: 2-(o-chloroanilino)-6-dibutylaminofluoran

[Coloring composition B-2]

Color developer: octadecyl phosphonic acid

Coloring agent: 2-chloro-6-diethylaminofluoran

A glass plate, serving as a support, with a thickness of about 1 mm was placed on a hot plate and heated to 170° C. at the surface thereof. A small amount of the particles of the above prepared composition B-1 was placed on the heated support to melt them. Thereafter, a glass plate with a thickness of 0.1 mm, serving as an intermediate layer, was put on the melt of the composition B-1 to expand it to form a uniform layer of the coloring composition B-1 . On the above intermediate layer, a small amount of the particles of the above prepared composition A-1 was placed to melt them. Thereafter, another glass plate, serving as a protective layer with a thickness of 0.1 mm was put on the melt of the composition A-1 to expand it to form a uniform layer of the coloring composition A-1. The laminated material thus obtained was removed from the hot plate and rapidly cooled by bringing it into contact with ice water. Thus, a reversible thermosensitive coloring recording medium of the present invention was obtained, in which a coloring composition layer B-1 in the color development state, an intermediate layer, a coloring composition layer A-1 in the color development state and a protective layer were successively overlaid on a support in this order.

The coloring composition layer A-1 produced a black color, while the coloring composition layer B-1 produced a red color.

The thus obtained reversible thermosensitive coloring recording medium was temporarily heated to 72° C., which temperature was within the decolorization temperature range of the coloring composition layer B-1, and then cooled, thereby decolorizing the coloring composition layer B-1. At this time, the coloring composition layer A-1 maintained the color development state at 72° C., because this temperature was above the color development temperature of the coloring composition layer A-1.

Subsequently, the recording medium was temporarily heated to 56° C., which temperature was within the decolorization temperature range of the coloring composition layer A-1, and then cooled, thereby decolorizing the coloring composition layer A-1. Both of the coloring composition layers A-1 and B-1 were thus brought into the respective decolorization states thereof, so that initialization of the recording medium was completed.

Using the above prepared recording medium in the initial decolorization state, the color development and decolorization operations (1) through (3) as shown in Table 3 were repeated 10 times.

TABLE 3

| | Color Development | | Decolorization | |
|---|---|---|---|---|
| | Operation | Produced color | Operation | Produced color |
| (1) | heated to 90° C. followed by rapid cooling. | red-tinged black | heated to 72° C. followed by rapid cooling. → heated to 56° C. followed by rapid cooling. | color-less |
| (2) | heated to 90° C. followed by rapid cooling. → heated by 56° C. followed by rapid cooling. | red | heated to 72° C. followed by rapid cooling. → heated to 56° C. followed by rapid cooling. | color-less |
| (3) | heated to 72° C. followed by rapid cooling. | black | heated to 56° C. followed by rapid cooling. | color-less |

As can be seen from the results in Table 3, three coloring states with different colors were respectively obtained by the color development and decolorization operations (1) to (3). In addition, the repetition of the color development and decolorization was steadily carried out.

EXAMPLE 2

The procedure for preparation of the reversible thermosensitive coloring recording medium in Example 1 was repeated except that the reversible thermosensitive coloring compositions A-1 and B-1 employed in Example 1 were respectively replaced by reversible thermosensitive coloring compositions A-2 and B-2, which were prepared by the following method:

[Preparation of Coloring Compositions A-2 and B-2]

The following color developer and coloring agent were mixed at a molar ratio of 4:1 and the mixture thus obtained was thoroughly pulverized, so that reversible thermosensitive coloring compositions A-2 and B-2 were separately prepared:

[Coloring composition A-2]

Color developer: hexadecyl phosphonic acid

Coloring agent: 2-(o-chloroanilino)-6-dibutylaminofluoran

[Coloring composition B-2]

Color developer: eicosyl phosphonic acid

Coloring agent: 1,2-benzo-6-(N-ethyl-p-toluidino)fluoran

Thus, a reversible thermosensitive coloring recording medium of the present invention was obtained, in which a coloring composition layer B-2 in the color development state, an intermediate layer, a coloring composition layer A-2 in the color development state and a protective layer were successively overlaid on a support in this order.

The thus obtained reversible thermosensitive coloring recording medium was temporarily heated to 80° C., which temperature was within the decolorization temperature range of the coloring composition layer B-2, and then cooled, thereby decolorizing the coloring composition layer B-2. At this time, the coloring composition layer A-2 maintained the color development state at 80° C., because this temperature was above the color development temperature of the coloring composition layer A-2.

Subsequently, the recording medium was temporarily heated to 64° C., which temperature was within the decolorization temperature range of the coloring composition layer A-2, and then cooled, thereby decolorizing the coloring composition layer A-2. Both of the coloring composition layers A-2 and B-2 were thus brought into the respective decolorization states thereof, so that initialization of the recording medium was completed.

Using the above prepared recording medium in the initial decolorization state, the color development and decolorization operations (1) through (3) as shown in Table 4 were repeated 10 times.

TABLE 4

| | Color Development | | Decolorization | |
|---|---|---|---|---|
| | Operation | Produced color | Operation | Produced color |
| (1) | heated to 100° C. followed by rapid cooling. | red-tinged black | heated to 80° C. followed by rapid cooling. → heated to 64° C. followed by rapid cooling. | color-less |
| (2) | heated to 100° C. followed by rapid cooling. → heated by 64° C. followed by rapid cooling. | red black | heated to 80° C. followed by rapid cooling. → heated to 64° C. followed by rapid cooling. | color-less |
| (3) | heated to 80° C. followed by rapid cooling. | black | heated to 64° C. followed by rapid cooling. | color-less |

As can be seen from the results in Table 4, three coloring states with different colors were respectively obtained by the color development and decolorization operations (1) to (3). In addition, the repetition of the color development and decolorization was steadily carried out.

EXAMPLE 3

The procedure for preparation of the reversible thermosensitive coloring recording medium in Example 2 was repeated except that the reversible thermosensitive coloring compositions A-2 and B-2 employed in Example 2 were respectively replaced by reversible thermosensitive coloring compositions A-3 and B-3 with the following formulation:

[Coloring composition A-3]

Color developer: octadecyl thiomalic acid

Coloring agent: 2-anilino-3-methyl-6-(N-cyclohexyl-N-methylamino)fluoran

[Coloring composition B-3]

Color developer: eicosyl thiomalic acid

Coloring agent: 1,2-benzo-6-(N-isopentyl-N-ethylamino)fluoran

Thus, a reversible thermosensitive coloring recording medium of the present invention was obtained, in which a coloring composition layer B-3 in the color development state, an intermediate layer, a coloring composition layer A-3 in the color development state and a protective layer were successively overlaid on a support in this order.

The thus obtained reversible thermosensitive coloring recording medium was temporarily heated to 65° C., which temperature was within the decolorization temperature range of the coloring composition layer B-3 and the coloring composition layer A-3, and then cooled, thereby decolorizing the coloring composition layers B-3 and A-3. Both of the coloring composition layers A-3 and B-3 were thus brought into the respective decolorization states thereof, so that initialization of the recording medium was completed.

Using the above prepared recording medium in the initial decolorization state, the color development and decolorization operations (1) and (2) as shown in Table 5 were repeated 10 times.

TABLE 5

| | Color Development | | Decolorization | |
|---|---|---|---|---|
| | Operation | Produced color | Operation | Produced color |
| (1) | heated to 105° C. followed by rapid cooling. | red-tinged black | heated to 65° C. followed by rapid cooling. | color-less |
| (2) | heated to 105° C. followed by rapid cooling. → heated by 50° C. followed by rapid cooling. | red | heated to 65° C. followed by rapid cooling. | color-less |

As can be seen from the results in Table 5, two coloring states with different colors were respectively obtained by the color development and decolorization operations (1) and (2). In addition, the repetition of the color development and decolorization was steadily carried out.

EXAMPLE 4

The procedure for preparation of the reversible thermosensitive coloring recording medium in Example 2 was repeated except that the reversible thermosensitive coloring compositions A-2 and B-2 employed in Example 2 were respectively replaced by reversible thermosensitive coloring compositions A-4 and B-4 with the following formulation:

[Coloring composition A-4]

Color developer: hexadecyl phosphonic acid

Coloring agent: 2-(N-methyl-anilino)-6-(N-ethyl-p-toluidino)fluoran

[Coloring composition B-4]

Color developer: docosyl phosphonic acid

Coloring agent: 1,2-benzo-6-(N-isoamyl-N-ethylamino)fluoran

Thus, a reversible thermosensitive coloring recording medium of the present invention was obtained, in which a coloring composition layer B-4 in the color development state, an intermediate layer, a coloring composition layer A-4 in the color development state and a protective layer were successively overlaid on a support in this order.

The thus obtained reversible thermosensitive coloring recording medium was temporarily heated to 84° C., which temperature was within the decolorization temperature range of the coloring composition layer B-4, and then cooled, thereby decolorizing the coloring composition layer B-4. At this time, the coloring composition layer A-4 maintained the color development state at 84° C., because this temperature was above the color development temperature of the coloring composition layer A-4.

Subsequently, the recording medium was temporarily heated to 64° C., which temperature was within the decolorization temperature range of the coloring composition layer A-4, and then cooled, thereby decolorizing the coloring composition layer A-4. Both of the coloring composition layers A-4 and B-4 were thus brought into the respective decolorization states thereof, so that initialization of the recording medium was completed.

Using the above prepared recording medium in the initial decolorization state, the color development and decolorization operations (1) through (3) as shown in Table 6 were repeated 10 times.

TABLE 6

| Color Development | | Decolorization | |
|---|---|---|---|
| Operation | Produced color | Operation | Produced color |
| (1) heated to 120° C. followed by rapid cooling. | mixed color of red and green | heated to 84° C. followed by rapid cooling. → heated to 64° C. followed by rapid cooling. | color-less |
| (2) heated to 120° C. followed by rapid cooling. → heated by 64° C. followed by rapid cooling. | red | heated to 84° C. followed by rapid cooling. → heated to 64° C. followed by rapid cooling. | color-less |
| (3) heated to 84° C. followed by rapid cooling. | green | heated to 64° C. followed by rapid cooling. | color-less |

As can be seen from the results in Table 6, three coloring states with different colors were respectively obtained by the color development and decolorization operations (1) to (3). In addition, the repetition of the color development and decolorization was steadily carried out.

EXAMPLE 5

Reversible thermosensitive coloring compositions C-1 and D-1 were separately prepared by thoroughly pulverizing and dispersing the following components in a ball mill until the particle diameter reached about 1 μm. Thus, coating liquids for reversible thermosensitive coloring coloring composition layers C-1 and D-1 were prepared.

| | Parts by Weight |
|---|---|
| [Coloring composition C-1] | |
| Color developer: | |
| docosyl phosphonic acid | 45 |
| Coloring agent: | |
| 2-(N-methyl)anilino-6-(N-ethyl-p-toluidino)fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |
| [Coloring composition D-1] | |
| Color developer: | |
| hexadecyl phosphonic acid | 35 |
| Coloring agent: | |
| 2-methyl-6-(N-ethyl-p-toluidino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |

Thus obtained coloring composition layer coating liquid C-1 was coated on a polyester film serving as a support, with a thickness of 100 μm and dried, so that a coloring composition layer C-1 with a thickness of about 5 μm was formed on the support.

An aqueous solution containing 10 wt. % of polyvinyl alcohol was coated on the above prepared coloring composition layer C-1 and dried, so that an intermediate layer with a thickness of about 2 μm was formed on the coloring composition layer C-1.

The above prepared coating liquid D-1 was coated on the intermediate layer and dried, so that a coloring composition layer D-1 with a thickness of about 5 μm was formed on the intermediate layer.

On a polyester film, serving as a protective layer, with a thickness of 4.5 μm, a coating liquid prepared by dissolving a commercially available saturated polyester resin "Vylon 300" (Trademark), made by Toyobo Co., Ltd., in a mixed solvent of toluene and methyl ethyl ketone was coated and dried to form an adhesive layer with a thickness of about 0.5 μm. The protective layer was superimposed on the previously obtained coloring composition layer D-1 in such a fashion that the adhesive layer was brought into contact with the coloring composition layer D-1, and a linear pressure of 2 kg was applied to the above-obtained laminated material film with a heat-application roller at a temperature of 125° C. Thus, a reversible thermosensitive coloring recording medium of the present invention was obtained, in which the coloring composition layer C-1, the intermediate layer, the coloring composition layer D-1 and the protective layer were successively overlaid on the support.

The above-mentioned recording medium was placed on a hot plate of 125° C. for about 10 seconds and rapidly cooled. Thereafter, the recording medium was put into an oven of 82° C. for 3 minutes, thereby decolorizing the coloring composition layer C-1. Subsequently, the recording medium was put into an oven of 63° C. for 3 minutes, thereby decolorizing the coloring composition layer D-1. Both of the coloring composition layers C-1 and D-1 were thus brought into the respective decolorization states thereof, so that initialization of the recording medium was completed.

Using the above prepared recording medium in the initial decolorization state, the color development properties were observed by carrying out the following operations as shown in Table 7:

TABLE 7

| | Operation | Color Development State | Produced color |
|---|---|---|---|
| Step 1-1 | heated to 125° C., followed by rapid cooling. | coloring composition layers C-1 and D-1 | mixed color of red and green |
| Step 1-2 | heated to 65° C., followed by rapid cooling. | coloring composition layer C-1 | green |
| Step 2-1 | heated to 125° C., followed by rapid cooling. | coloring composition layers C-1 and D-1 | mixed color of red and green |
| Step 2-2 | heated to 85° C., followed by rapid cooling. | coloring composition layer D-1 | red |

In the above operations, the recording medium was heated by placing it on the hot plate of the above-mentioned temperature for 10 seconds, and rapid cooling was carried out by bringing the back side of the support of the recording medium into contact with a cooling sheet of 1° C. immediately after heating operation.

As can be seen from the results in Table 7, three coloring states with different colors were obtained at one step or two steps by the above-mentioned heating and cooling operations. Each of the three coloring states was initialized by heating the recording medium to 85° C., followed by rapid cooling and thereafter heating it to 65° C., followed by rapid cooling.

In addition, the repetition of the color development and decolorization was steadily carried out.

EXAMPLE 6

The procedure for preparation of the reversible thermosensitive coloring recording medium in Example 5 was repeated except that the reversible thermosensitive coloring compositions C-1 and D-1 used as the coating liquids for the coloring composition layers C-1 and D-1 in Example 5 were respectively replaced by reversible thermosensitive coloring compositions C-2 and D-2 with the following formulations, so that a reversible thermosensitive coloring recording medium of the present invention was obtained:

| | Parts by Weight |
|---|---|
| [Coloring composition C-2] | |
| Color developer: | |
| docosyl phosphonic acid | 45 |
| Coloring agent: | |
| 2-anilino-6-(N-ethyl-N-n-hexylamino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |
| [Coloring composition D-2] | |
| Color developer: | |
| hexadecyl phosphonic acid | 35 |
| Coloring agent: | |
| 2-methyl-6-(N-ethyl-p-toluidino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |

Both of the obtained coloring composition layers C-2 and D-2 were brought into the respective decolorization states thereof in the same manner as in Example 5, so that initialization of the recording medium was completed.

Using the above prepared recording medium in the initial decolorization state, the color development properties were observed by carrying out the following operations as shown in Table 8:

TABLE 8

| | Operation | Color Development State | Produced color |
|---|---|---|---|
| Step 1-1 | heated to 125° C., followed by rapid cooling. | coloring composition layers C-2 and D-2 | mixed color of red and green |
| Step 1-2 | heated to 65° C., followed by rapid cooling. | coloring composition layer C-2 | green |
| Step 2-1 | heated to 125° C., followed by rapid cooling. | coloring composition layers C-2 and D-2 | mixed color of red and green |
| Step 2-2 | heated to 85° C., followed by rapid cooling. | coloring composition layer D-2 | red |

In the above operations, the recording medium was heated by placing it on the hot plate of the above-mentioned temperature for 10 seconds, and rapid cooling was carried out by bringing the back side of the support of the recording medium into contact with a cooling sheet of 1° C. immediately after heating operation.

As can be seen from the results in Table 8, three coloring states with different colors were obtained at one step or two steps by the above-mentioned heating and cooling operations. Each of the three coloring states was initialized in the same manner as in Example 5.

In addition, the repetition of the color development and decolorization was steadily carried out.

Furthermore, the recording medium was initialized to bring both of the coloring composition layers C-2 and D-2 into the respective decolorization states thereof, so that the recording medium assumed the initial decolorization state. To observe the produced color in the recording medium, the thermal energy was imagewise applied to the recording medium by use of a thermal head under the conditions (1) and (2) as shown in Table 9. The results are given in Table 9.

TABLE 9

| Conditions | Applied Voltage | Pulse Width | Color Development State | Produced color |
|---|---|---|---|---|
| (1) | 13.3 V | 1.8 msec | coloring composition layers C-2 and D-2 | mixed color of red and green |
| (2) | 13.3 V | 0.5 msec | coloring composition layer D-2 | red |

As is apparent from the results in Table 9, the produced color of the recorded images formed in the recording medium varied depending on the conditions of the thermal energy applied to the recording medium.

EXAMPLE 7

The procedure for preparation of the reversible thermosensitive coloring recording medium in Example 5 was repeated except that the reversible thermosensitive coloring compositions C-1 and D-1 used as the coating liquids for the coloring composition layers C-1 and D-1 in Example 5 were respectively replaced by reversible thermosensitive coloring compositions C-3 and D-3 with the following formulations, so that a reversible thermosensitive coloring recording medium of the present invention was obtained:

| | Parts by Weight |
|---|---|
| [Coloring composition C-3] | |
| Color developer: docosyl phosphonic acid | 45 |
| Coloring agent: 2-anilino-6-(N-ethyl-N-n-hexylamino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |
| [Coloring composition D-3] | |
| Color developer: hexadecyl phosphonic acid | 35 |
| Coloring agent: 1,2-benzo-6-(N-ethyl-N-isoamylamino)- | 10 |

-continued

| | Parts by Weight |
|---|---|
| fluoran | |
| Vinyl chloride-vinyl acetate copolymer "VYHH" (Trademark), made by Union Carbide Japan K.K. | 45 |
| Toluene | 200 |
| Methyl ethyl ketone | 200 |

Both of the obtained coloring composition layers C-3 and D-3 were brought into the respective decolorization states thereof in the same manner as in Example 5, so that initialization of the recording medium was completed.

Using the above prepared recording medium in the initial decolorization state, the color development properties were observed by carrying out the following operations as shown in Table 10:

TABLE 10

| | Operation | Color Development State | Produced color |
|---|---|---|---|
| Step 1-1 | heated to 125° C., followed by rapid cooling. | coloring composition layers C-3 and D-3 | mixed color of red and green |
| Step 1-2 | heated to 65° C., followed by rapid cooling. | coloring composition layer C-3 | green |
| Step 2-1 | heated to 125° C., followed by rapid cooling. | coloring composition layers C-3 and D-3 | mixed color of red and green |
| Step 2-2 | heated to 85° C., followed by rapid cooling. | coloring composition layer D-3 | red |

In the above operations, the recording medium was heated by placing it on the hot plate of the above-mentioned temperature for 10 seconds, and rapid cooling was carried out by bringing the back side of the support of the recording medium into contact with a cooling sheet of 1° C. immediately after heating operation.

As can be seen from the results in Table 10, three coloring states with different colors were obtained at one step or two steps by the above-mentioned heating and cooling operations. Each of the three coloring states was initialized in the same manner as in Example 5.

In addition, the repetition of the color development and decolorization was steadily carried out.

Furthermore, the recording medium was initialized to bring both of the coloring composition layers C-3 and D-3 into the respective decolorization states thereof. To observe the produced color in the recording medium, the thermal energy was imagewise applied to the recording medium by use of a thermal head under the conditions (1) and (2) as shown in Table 11. The results are given in Table 11.

TABLE 11

| Conditions | Applied Voltage | Pulse Width | Color Development State | Produced color |
|---|---|---|---|---|
| (1) | 13.3 V | 1.8 msec | coloring composition layers C-3 and D-3 | mixed color of red and green |
| (2) | 13.3 V | 0.5 msec | coloring composition layer D-3 | red |

As is apparent from the results in Table 11, the produced color of the recorded images formed in the recording medium varied depending on the conditions of the thermal energy applied to the recording medium.

EXAMPLE 8

The procedure for preparation of the reversible thermosensitive coloring recording medium in Example 5 was repeated except that the reversible thermosensitive coloring compositions C-1 and D-1 used as the coating liquids for the coloring composition layers C-1 and D-1 in Example 5 were respectively replaced by reversible thermosensitive coloring compositions C-4 and D-4 with the following formulations, so that a reversible thermosensitive coloring recording medium of the present invention was obtained:

| | Parts by Weight |
|---|---|
| [Coloring composition C-4] | |
| Color developer: hexadecyl phosphonic acid | 35 |
| Coloring agent: 1,2-benzo-6-(N-ethyl-N-isoamylamino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |
| [Coloring composition D-4] | |
| Color developer: docosyl phosphonic acid | 45 |
| Coloring agent: 2-(N-methyl)anilino-6-(N-methyl-p-toluidino)fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |

Both of the obtained coloring composition layers C-4 and D-4 were brought into the respective decolorization states thereof in the same manner as in Example 5, so that initialization of the recording medium was completed.

Using the above prepared recording medium in the initial decolorization state, the color development properties were observed by carrying out the following operations as shown in Table 12:

TABLE 12

| | Operation | Color Development State | Produced color |
|---|---|---|---|
| Step 1-1 | heated to 125° C., followed by rapid cooling. | coloring composition layers C-4 and D-4 | mixed color of red and green |
| Step 1-2 | heated to 65° C., followed by rapid cooling. | coloring composition layer D-4 | green |
| Step 2-1 | heated to 125° C., followed by rapid cooling. | coloring composition layers C-4 and D-4 | mixed color of red and green |
| Step 2-2 | heated to 85° C., followed by rapid cooling. | coloring composition layer C-4 | red |

In the above operations, the recording medium was heated by placing it on the hot plate of the above-mentioned temperature for 10 seconds, and rapid cooling was carried out by bringing the back side of the support of the recording medium into contact with a cooling sheet of 1° C. immediately after heating operation.

As can be seen from the results in Table 12, three coloring states with different colors were obtained at one step or two steps by the above-mentioned heating and cooling operations. Each of the three coloring states was initialized in the same manner as in Example 5.

In addition, the repetition of the color development and decolorization was steadily carried out.

EXAMPLE 9

The same reversible thermosensitive coloring recording medium as prepared in Example 5 was heated to 125° C. by placing it on a hot plate, and rapidly cooled. Both of the coloring composition layers C-1 and D-1 were brought into the respective color development states thereof, thereby producing a mixed color of red and green. Thereafter the thermal energy was imagewise applied to the recording medium in the mixed coloring state by use of a thermal head under the conditions (1) and (2) as shown in Table 13. The results are given in Table 13.

TABLE 13

| Conditions | Applied Voltage | Pulse Width | Color Development State | Produced color |
|---|---|---|---|---|
| (1) | 13.3 V | 1.6 msec | coloring composition layer D-1 | red |
| (2) | 8.0 V | 0.9 msec | coloring composition layer C-1 | green |

As is apparent from the results in Table 13, a red or green image was formed on the background of the mixed color of red and green depending on the conditions of the thermal energy applied to the recording medium.

EXAMPLE 10

The procedure for preparation of the reversible thermosensitive coloring recording medium in Example 5 was repeated except that the reversible thermosensitive coloring compositions C-1 and D-1 used as the coating liquids for the coloring composition layers C-1 and D-1 in Example 5 were respectively replaced by reversible thermosensitive coloring compositions C-5 and D-5 with the following formulations, so that a reversible thermosensitive coloring recording medium of the present invention was obtained:

| | Parts by Weight |
|---|---|
| [Coloring composition C-5] | |
| Color developer: docosyl phosphonic acid | 45 |
| Coloring agent: 1,2-benzo-6-(N-ethyl-N-isoamylamino)-fluoran | 10 |
| Vinyl chloride-vinyl acetate copolymer | 45 |
| Toluene | 200 |
| Methyl ethyl ketone | 200 |
| [Coloring composition D-5] | |
| Color developer: hexadecyl phosphonic acid | 35 |
| Coloring agent: 2-(N-methyl)anilino-6-(N-ethyl-p-toluidino)fluoran | 10 |
| Vinyl chloride-vinyl acetate copolymer | 45 |
| Toluene | 200 |
| Methyl ethyl ketone | 200 |

Both of the coloring composition layers C-5 and D-5 were brought into the respective color development states thereof by the same method as in Example 9, thereby producing a mixed color of red and green. Thereafter the thermal energy was imagewise applied to the recording medium in the mixed coloring state by use of a thermal head under the conditions (1) and (2) as shown in Table 14. The results are given in Table 14.

TABLE 14

| Conditions | Applied Voltage | Pulse Width | Color Development State | Produced color |
|---|---|---|---|---|
| (1) | 13.3 V | 1.6 msec | coloring composition layer D-5 | green |
| (2) | 8.0 V | 0.8 msec | coloring composition layer C-5 | red |

As is apparent from the results in Table 14, a red or green image was formed on the background of the mixed color of red and green depending on the conditions of the thermal energy applied to the recording medium.

EXAMPLE 11

Reversible thermosensitive coloring compositions E-1 and F-1 were separately prepared by thoroughly pulverizing and dispersing the following components in a ball mill until the particle diameter reached about 1 μm. Thus, coating liquids for reversible thermosensitive coloring coloring composition layers E-1 and F-1 were prepared.

| | Parts by Weight |
|---|---|
| [Coloring composition E-1] | |
| Color developer: docosyl phosphonic acid | 45 |
| Coloring agent: 1,2-benzo-6-(N-ethyl-N-isoamylamino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |
| [Coloring composition F-1] | |
| Color developer: hexadecyl phosphonic acid | 35 |
| Coloring agent: 2-anilino-6-(N-ethyl-N-n-hexylamino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |

The thus obtained coloring composition layer coating liquid F-1 was coated on a polyester film with a thickness of 100 μm and dried, so that a coloring composition layer F-1 with a thickness of about 5 μm was formed on the support.

On one side of a polyester film, serving as an intermediate layer, with a thickness of 4.5 μm, a coating liquid prepared by dissolving a commercially available saturated polyester resin "Vylon 300" (Trademark), made by Toyobo Co., Ltd., in a mixed solvent of toluene and methyl ethyl ketone was coated in a deposition amount of 3 g/m$^2$ on a dry basis, and dried to form an adhesive layer on the intermediate layer. The intermediate layer was superimposed on the previously obtained coloring composition layer F-1 in such a fashion that the adhesive layer was brought into contact with the coloring composition layer F-1, and a linear pressure of 2 kg was applied to the above obtained laminated material with a heat-application roller at a temperature of 125° C.

The above prepared coating liquid E-1 was coated on the intermediate layer and dried, so that a coloring composition layer E-1 with a thickness of about 5 μm was formed on the intermediate layer.

Thus, a reversible thermosensitive coloring recording medium of the present invention was obtained, in which the coloring composition layer F-1, the intermediate layer, and the coloring composition layer E-1 were successively overlaid on the support.

The above-mentioned recording medium was placed on a hot plate of 125° C. for about 20 seconds and rapidly cooled to bring both of the coloring composition layers E-1 and F-1 into the respective color development states thereof. Thereafter, the recording medium was put into an oven of 82° C., thereby decolorizing the coloring composition layer E-1. Subsequently, the recording medium was put into an oven of 63° C., thereby decolorizing the coloring composition layer F-1. Both of the coloring composition layers E-1 and F-1 were thus brought into the respective decolorization states thereof, namely, substantially transparent states, so that initialization of the recording medium was completed.

Using the above prepared recording medium in the initial decolorization state, the color development properties were observed by carrying out the following operations as shown in Table 15:

TABLE 15

| | Operation | Color Development State | Produced color |
|---|---|---|---|
| Step 1-1 | heated to 125° C., followed by rapid cooling. | coloring composition layers E-1 and F-1 | mixed color of red and green |
| Step 1-2 | heated to 67° C., followed by rapid cooling. | coloring composition layer E-1 | red |
| Step 2-1 | heated to 125° C., followed by rapid cooling. | coloring composition layers E-1 and F-1 | mixed color of red and green |
| Step 2-2 | heated to 85° C., followed by rapid cooling. | coloring composition layer F-1 | green |

In the above operations, the recording medium was heated by placing it on the hot plate of the above-mentioned temperature for 10 seconds, and rapid cooling was carried out by bringing the back side of the support of the recording medium into contact with a cooling sheet of 1° C. immediately after heating operation.

As can be seen from the results in Table 15, three coloring states with different colors were obtained at one step or two steps by the above-mentioned heating and cooling operations. Each of the three coloring states was initialized by heating the recording medium to 85° C., followed by rapid cooling and thereafter heating it to 67° C., followed by rapid cooling.

In addition, the repetition of the color development and decolorization was steadily carried out.

EXAMPLE 12

The procedure for preparation of the reversible thermosensitive coloring recording medium in Example 11 was repeated except that the reversible thermosensitive coloring compositions E-1 and F-1 used as the coating liquids for the coloring composition layers E-1 and F-1 in Example 11 were respectively replaced by reversible thermosensitive coloring compositions E-2 and F-2 with the following formulations, so that a reversible thermosensitive coloring recording medium of the present invention was obtained:

| | Parts by Weight |
|---|---|
| [Coloring composition E-2] | |
| Color developer: docosyl phosphonic acid | 45 |
| Coloring agent: 2-anilino-6-(N-ethyl-N-n-hexylamino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |
| [Coloring composition F-2] | |
| Color developer: hexadecyl phosphonic acid | 35 |
| Coloring agent: 1,2-benzo-6-(N-ethyl-N-isoamylamino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |

The thus obtained coloring composition layer coating liquid F-2 was coated on a polyester film, serving as a support with a thickness of 100 μm and dried, so that a coloring composition layer F-2 with a thickness of about 5 μm was formed on the support.

On one side of an aromatic polyamide film, serving as an intermediate layer, with a thickness of 4 μm, a coating liquid prepared by dissolving a commercially available saturated polyester resin "Vylon 200" (Trademark), made by Toyobo Co., Ltd., in a mixed solvent of toluene and methyl ethyl ketone was coated in a deposition amount of 3 g/m$^2$ on a dry basis, and dried to form an adhesive layer on the intermediate layer. The intermediate layer was superimposed on the previously obtained coloring composition layer F-2 in such a fashion that the adhesive layer was brought into contact with the coloring composition layer F-2, and a linear pressure of 2 kg was applied to the above obtained laminated material with a heat-application roller at a temperature of 125° C.

The above prepared coating liquid E-2 was coated on the intermediate layer and dried, so that a coloring composition layer E-2 with a thickness of about 5 μm was formed on the intermediate layer.

The same aromatic polyamide film carrying a saturated polyester resin thereon as employed for preparation of the above-mentioned intermediate layer was superimposed on the previously obtained coloring composition layer E-2 in such a fashion that the adhesive layer was brought into contact with the coloring composition layer E-2, and a linear pressure of 2 kg was applied to the above obtained laminated material with a heat-application roller at a temperature of 125° C.

Thus, a reversible thermosensitive coloring recording medium of the present invention was obtained, in which the coloring composition layer F-2, the intermediate layer, the coloring composition layer E-2 and the protective layer were successively overlaid on the support.

Both of the obtained coloring composition layers E-2 and F-2 were brought into the respective decolorization states thereof in the same manner as in Example 11, so that initialization of the recording medium was completed.

Using the above prepared recording medium in the initial decolorization state, the color development properties were observed by carrying out the following operations as shown in Table 16:

TABLE 16

| | Operation | Color Development State | Produced color |
|---|---|---|---|
| Step 1-1 | heated to 125° C., followed by rapid cooling. | coloring composition layers E-2 and F-2 | mixed color of red and green |
| Step 1-2 | heated to 67° C., followed by rapid cooling. | coloring composition layer E-2 | green |
| Step 2-1 | heated to 125° C., followed by rapid cooling. | coloring composition layers E-2 and F-2 | mixed color of red and green |
| Step 2-2 | heated to 85° C., followed by rapid cooling. | coloring composition layer F-2 | red |

In the above operations, heating and cooling of the recording medium was carried out in the same manner as in Example 11.

As can be seen from the results in Table 16, three coloring states with different colors were obtained at one step or two steps by the above-mentioned heating and cooling operations. Each of the three coloring states was initialized in the same manner as in Example 11.

In addition, the repetition of the color development and decolorization was steadily carried out.

EXAMPLE 13

The procedure for preparation of the reversible thermosensitive coloring recording medium in Example 11 was repeated except that the polyester film with a thickness of 4.5 μm used in preparation of the intermediate layer in Example 11 was replaced by a polyimide film with a thickness of 4 μm, so that a reversible thermosensitive coloring recording medium of the present invention was obtained.

The thus prepared recording medium was initialized and the color development properties thereof were observed in the same manner as in Example 11. In this recording medium, three coloring states with different colors were obtained at one step or two steps by the heating and cooling operations.

In addition, the repetition of the color development and decolorization was steadily carried out.

EXAMPLE 14

The procedure for preparation of the reversible thermosensitive coloring recording medium in Example 11 was repeated except that the polyester film with a thickness of 4.5 μm used in preparation of the intermediate layer in Example 11 was replaced by a polyparabanic acid film with a thickness of 5 μm, so that a reversible thermosensitive coloring recording medium of the present invention was obtained.

The thus prepared recording medium was initialized and the color development properties thereof were observed in the same manner as in Example 11. In this recording medium, three coloring states with different colors were obtained at one step or two steps by the heating and cooling operations.

In addition, the repetition of the color development and decolorization was steadily carried out.

EXAMPLE 15

Reversible thermosensitive coloring compositions G-1, H-1 and I-1 were separately prepared by thoroughly pulverizing and dispersing the following components in a ball mill until the particle diameter reached about 1 μm. Thus, coating liquids for coloring composition layers G-1, H-1 and I-1 were prepared.

| | Parts by Weight |
|---|---|
| [Coloring composition G-1] | |
| Color developer: docosyl phosphonic acid | 45 |
| Coloring agent: 1,2-benzo-6-(N-ethyl-N-isoamylamino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |
| [Coloring composition H-1] | |
| Color developer: octadecyl phosphonic acid | 40 |
| Coloring agent: 2-anilino-6-(N-ethyl-N-n-hexylamino)-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |
| [Coloring composition I-1] | |
| Color developer: tetradecyl phosphonic acid | 35 |
| Coloring agent: 2-(o-chloroanilino)-6-dibutylamino-fluoran | 10 |
| Vinyl chloride-vinyl acetate copolymer "VYHH" (Trademark), made by Union Carbide Japan K.K. | 45 |
| Toluene | 200 |
| Methyl ethyl ketone | 200 |

The thus obtained coloring composition layer coating liquid I-1 was coated on a polyester film with a thickness of 100 μm and dried, so that a coloring composition layer I-1 with a thickness of about 5 μm was formed on the support.

On one side of a polyester film, serving as a first intermediate layer, with a thickness of 4.5 μm, a coating liquid prepared by dissolving a commercially available saturated polyester resin "Vylon 300" (Trademark), made by Toyobo Co., Ltd., in a mixed solvent of toluene and methyl ethyl ketone was coated in a deposition amount of 3 g/m$^2$ on a dry basis, and dried to form an adhesive layer on the first intermediate layer. The first intermediate layer was superimposed on the previously obtained coloring composition layer I-1 in such a fashion that the adhesive layer was brought into contact with the coloring composition layer I-1, and a linear pressure of 2 kg was applied to the above obtained laminated material with a heat-application roller at a temperature at 125° C.

The above prepared coating liquid H-1 was coated on the first intermediate layer and dried, so that a coloring composition layer H-1 with a thickness of about 5 μm was formed on the first intermediate layer.

A second intermediate layer was formed on the coloring composition layer H-1 in the same manner as in the preparation of the first intermediate layer.

The above prepared coating liquid G-1 was coated on the second intermediate layer and dried, so that a coloring composition layer G-1 with a thickness of about 5 μm was formed on the second intermediate layer.

The same aromatic polyamide film carrying a saturated polyester resin thereon as employed for preparation of the protective layer in Example 12 was superimposed on the previously obtained coloring composition layer G-1 in such a fashion that the adhesive layer was brought into contact with the coloring composition layer G-1, and a linear pressure of 2 kg was applied to the above obtained laminated material with a heat-application roller at a temperature of 125° C.

Thus, a reversible thermosensitive coloring recording medium of the present invention was obtained, in which the coloring composition layer I-1, the first intermediate layer, the coloring composition layer H-1, the second intermediate layer, the coloring composition layer G-1, and the protective layer were successively overlaid on the support.

The thus obtained recording medium was initialized by bringing all of the coloring composition layers G-1, H-1, and I-1 into the respective decolorization states thereof in such a manner that the reversible thermosensitive coloring compositions in the coloring composition layers were successively decolorized in the order from a coloring composition with a higher decolorization temperature range to a coloring composition with a lower decolorization temperature range.

Using the above prepared recording medium in the initial decolorization state, the color development properties were observed by carrying out the following operations as shown in Table 17:

TABLE 17

| | Operation | Color Development State | Produced color |
|---|---|---|---|
| Step 1-1 | heated to 125° C., followed by rapid cooling. | coloring composition layers G-1, H-1 and I-1 | mixed color of red, green and black |
| Step 1-2 | heated to 70° C., followed by rapid cooling. | coloring composition layers G-1 and I-1 | mixed color of red and black |
| Step 1-3 | heated to 55° C., followed by rapid cooling. | coloring composition layer G-1 | red |
| Step 2-1 | heated to 125° C., followed by rapid cooling. | coloring composition layers G-1, H-1 and I-1 | mixed color of red, green and black |
| Step 2-2 | heated to 85° C., followed by rapid cooling. | coloring composition layers H-1 and I-1 | mixed color of green and black |
| Step 2-3 | heated to 55° C., followed by rapid cooling. | coloring composition layer H-1 | green |
| Step 3-1 | heated to 125° C., followed by rapid cooling. | coloring composition layers G-1, H-1 and I-1 | mixed color of red, green and black |
| Step 3-2 | heated to 85° C., followed by rapid cooling. | coloring composition layers H-1 and I-1 | mixed color of green and black |
| Step 3-3 | heated to 70° C., followed by rapid cooling. | coloring composition layer I-1 | black |

In the above operations, heating and cooling of the recording medium was carried out in the same manner as in Example 11.

As can be seen from the results in Table 17, multi-color images including red, green, black and a mixed color thereof, were produced in the recording medium.

In addition, the repetition of the color development and decolorization was steadily carried out.

EXAMPLE 6

Microcapsules of reversible thermosensitive coloring compositions J-1 and K-1 were separately prepared by the following method:

1.5 g of a commercially available vinyl chloride-vinyl acetate copolymer "VYHH" (Trademark), made by Union Carbide Japan K. K., were dissolved in 20 g of methylene chloride to prepare a solution. A mixture of 2-anilino-6-(N-ethyl-N-n-hexylamino)fluoran, serving as a coloring agent and docosyl phosphonic acid serving as a color developer at a molar ratio of 1:4 was dispersed in the above prepared solution, so that a dispersion was obtained. This dispersion was put into an aqueous solution containing a surface active agent to prepare a W/O emulsion. The component of methylene chloride in the W/O emulsion was caused to evaporate by vigorous stirring to form a film wall of a capsule. Thereafter, the W/O emulsion was filtered off, washed with water and dried under reduced pressure, whereby microcapsules of reversible thermosensitive coloring composition J-1 were obtained in the form of finely-divided particles.

Using a mixture of 1,2-benzo-6-(N-ethyl-N-isoamylamino)fluoran, serving as a coloring agent and hexadecyl phosphonic acid serving as a color developer at a molar ratio of 1:4, microcapsules of reversible thermosensitive coloring composition K-1 were obtained in the form of finely-divided particles in the same manner as in above.

The following components were mixed to prepare a coating liquid for a reversible thermosensitive coloring recording layer:

| | Parts by Weight |
|---|---|
| Microcapsules of reversible thermosensitive coloring composition J-1 | 5 |
| Microcapsules of reversible thermosensitive coloring composition K-1 | 5 |
| Aqueous dispersion of ionomer | 30 |

-continued

| | Parts by Weight |
|---|---|
| "Hydran AP-40" (Trademark), made by Dainippon Ink & Chemicals, Incorporated | |
| Melamine-based crosslinking agent "Deckamine PM-N" (Trademark), made by Dainippon Ink & Chemicals, Incorporated | 1.5 |
| Catalyst "Catalyst ES-2" (Trademark), made by Dainippon Ink & chemicals, Incorporated | 0.7 |

The coating liquid thus obtained was coated on a polyester film, serving as a support, with a thickness of 100 μm and dried at 100° C. for 10 minutes, so that a reversible thermosensitive coloring recording layer with a thickness of 10 μm was formed on the support.

Thus, a reversible thermosensitive coloring recording medium of the present invention was obtained, in which the reversible thermosensitive coloring recording layer was overlaid on the support.

The thus prepared recording medium was initialized to bring both of the reversible thermosensitive coloring compositions J-1 and K-1 in the reversible thermosensitive coloring recording layer into the respective decolorization states thereof by the same method as in Example 5, and the color development properties thereof were observed in the same manner as in Example 7. As a result, the same color development properties as in Example 7 were obtained.

EXAMPLE 17

The following color developer and coloring agent were mixed at a molar ratio of 5:1 and the mixture thus obtained was thoroughly pulverized, so that a reversible thermosensitive coloring composition L-1 was prepared:

[Reversible thermosensitive coloring composition L-1]

Color developer: octadecyl phosphonic acid

Coloring agent: 2-(o-chloroanilino)-6-dibutylaminofluoran

A glass plate, serving as a support, with a thickness of about 1 mm was placed on a hot plate and heated to 170° C. A small amount of the particles of the above prepared reversible thermosensitive coloring composition L-1 was placed on the heated support to melt them. Thereafter, a glass plate with a thickness of 0.1 mm was put on the melt of the composition L-1 to expand it to form a uniform layer of the coloring composition L-1. Thus, a reversible thermosensitive coloring recording layer L-1 was formed on the support. This laminated material was removed from the hot plate and rapidly cooled by bringing it into contact with ice water, so that the reversible thermosensitive coloring composition L-1 assumed a color development state. Then, the glass plate over the melt of the composition L-1 was peeled, and an aqueous solution containing 5 wt. % of polyvinyl alcohol was coated on the composition L-1 in the color development state and dried, so that an intermediate layer was formed on the reversible thermosensitive coloring recording layer.

The following components were mixed and dispersed in a ball mill for 24 hours:

| | Parts by Weight |
|---|---|
| 2-chloro-6-diethylaminofluoran | 10 |
| 2,2-bis(p-hydroxyphenyl)propane | 30 |
| Vinyl chloride-vinyl acetate copolymer "VYHH" (Trademark), made by Union Carbide Japan K.K. | 45 |
| Tetrahydrofuran | 250 |

The above prepared coating liquid for an irreversible coloring recording layer was coated on the intermediate layer and dried. Thus, a reversible thermosensitive coloring recording medium of the present invention was obtained, in which the reversible thermosensitive coloring recording layer L-1 in the color development state, the intermediate layer, the irreversible coloring recording layer in a decolorization state were successively overlaid on the support in this order.

The thus obtained reversible thermosensitive coloring recording medium was temporarily heated to 72° C., and then cooled rapidly, thereby decolorizing the recording layer L-1. Thus, initialization of the recording medium was completed.

Using the above prepared recording medium in the initial decolorization state, the heating and rapid cooling operations (1) to (3) as shown in Table 18 were carried out individually.

TABLE 18

| Operation | Color Development State | Produced color |
|---|---|---|
| (1) heated to 120° C., followed by rapid cooling. | reversible thermosensitive recording layer L-1 and irreversible recording layer | red tinged black |
| (2) heated to 90° C., followed by rapid cooling. | reversible thermosensitive recording layer L-1 | black |
| (3) heated to 120° C., followed by rapid cooling - heated to 72° C., followed by rapid cooling. | irreversible recording layer | red |

As can be seen from the results in Table 18, three coloring states with different colors were respectively obtained by the color development and decolorization operations (1) to (3).

In this recording medium, a black image can be reversibly formed on a red background once the irreversible recording layer is brought into the color development state.

EXAMPLE 18

The procedure for preparation of the reversible thermosensitive coloring recording medium in Example 17 was repeated except that the reversible thermosensitive coloring composition L-1 for use in the reversible thermosensitive coloring recording layer L-1 employed in Example 17 was replaced by a reversible thermosensitive coloring composition L-2 with the following formulation, so that a reversible thermosensitive coloring recording medium of the present invention was obtained:

[Reversible thermosensitive coloring composition L-2]

Color developer: hexadecyl phosphonic acid

Coloring agent: 2-anilino-3-methyl-6-(N-ethyl-p-toluidino)fluoran

The thus obtained reversible thermosensitive coloring recording medium was initialized by bringing the reversible thermosensitive coloring recording layer L-2 in the color decolorization state in the same manner as in Example 17.

Using the above prepared recording medium in the initial decolorization state, the heating and rapid cooling operations (1) to (3) as shown in Table 19 were carried out individually.

TABLE 19

| Operation | Color Development State | Produced color |
|---|---|---|
| (1) heated to 120° C., followed by rapid cooling. | reversible thermosensitive recording layer L-2 and irreversible recording layer | red tinged black |
| (2) heated to 90° C., followed by rapid cooling. | reversible thermosensitive recording layer L-2 | black |
| (3) heated to 120° C., followed by rapid cooling - heated to 75° C., followed by rapid cooling. | irreversible recording layer | red |

As can be seen from the results in Table 19, three coloring states with different colors were respectively obtained by the color development and decolorization operations (1) to (3).

In this recording medium, a black image can be reversibly formed on a red background once the irreversible recording layer is brought into the color development state.

EXAMPLE 19

The procedure for preparation of the reversible thermosensitive coloring recording medium in Example 17 was repeated except that the reversible thermosensitive coloring composition L-1 for use in the reversible thermosensitive coloring recording layer L-1 employed in Example 17 was replaced by a reversible thermosensitive coloring composition L-3 with the following formulation, so that a reversible thermosensitive coloring recording medium of the present invention was obtained:

[Reversible thermosensitive coloring composition L-3]

Color developer: eicosyl thiomalic acid

Coloring agent: 2-anilino-3-methyl-6-diethylaminofluoran

The thus obtained reversible thermosensitive coloring recording medium was initialized by bringing the reversible thermosensitive coloring recording layer L-3 in the color decolorization state in the same manner as in Example 17.

Using the above prepared recording medium in the initial decolorization state, the heating and rapid cooling operations (1) to (3) as shown in Table 20 were carried out individually.

TABLE 20

| Operation | Color Development State | Produced color |
|---|---|---|
| (1) heated to 120° C., followed by rapid cooling. | reversible thermosensitive recording layer L-3 and irreversible recording layer | red tinged black |
| (2) heated to 90° C., followed by rapid cooling. | reversible thermosensitive recording layer L-3 | black |
| (3) heated to 120° C., followed by rapid cooling - heated to 70° C., followed by rapid cooling. | irreversible recording layer | red |

As can be seen from the results in Table 20, three coloring states with different colors were respectively obtained by the color development and decolorization operations (1) to (3).

In this recording medium, a black image can be reversibly formed on a red background once the irreversible recording layer is brought into the color development state.

As is obvious from the above description, multi-color image formation and erasure can be repeatedly carried out with ease only by the application of heat to the reversible thermosensitive coloring recording medium according to the present invention. The multi-color images obtained on the reversible thermosensitive coloring recording medium according to the present invention can be maintained in a stable condition at room temperature, and the images can be partially or entirely erased from the recording medium. The color of the multi-color image can be changed by selecting the color developer for use in the color composition to be used, so that a full-color image can also be achieved in the reversible thermosensitive coloring recording medium of the present invention when the color developers capable of inducing color formation of the three primary colors are employed.

What is claimed is:

1. A reversible thermosensitive coloring recording medium comprising:

a support, and a reversible thermosensitive coloring recording layer formed thereon, said reversible thermosensitive coloring recording layer comprising a plurality of reversible thermosensitive coloring composition layers which are successively overlaid one on top of the other, each of said reversible thermosensitive coloring composition layers being independently present separated from the other reversible thermosensitive coloring composition layers, and capable of reversibly forming a color development state with a different color in a predetermined color development temperature range, and a decolorization state in a predetermined decolorization temperature range by the application of heat thereto and maintaining said color development state and said decolorization state at room temperature, said decolorization temperature range being located lower in terms of temperature than said color development temperature range therefor.

2. The reversible thermosensitive coloring recording medium as claimed in claim 1, wherein each of said coloring composition layers comprises one of said reversible thermosensitive coloring compositions.

3. The reversible thermosensitive coloring recording medium as claimed in claim 2, further comprising at least one intermediate layer, which is interposed between said coloring composition layers.

4. The reversible thermosensitive coloring recording medium as claimed in claim 3, wherein said intermediate layer comprises a water-soluble resin.

5. The reversible thermosensitive coloring recording medium as claimed in claim 3, wherein said intermediate layer comprises a heat-resistant resin.

6. The reversible thermosensitive coloring recording medium as claimed in claim 2, further comprising an irreversible thermosensitive coloring composition in said reversible thermosensitive coloring recording layer, said irreversible coloring composition being independently present separated from said reversible thermosensitive coloring compositions.

7. The reversible thermosensitive coloring recording medium as claimed in claim 6, further comprising an irreversible thermosensitive recording layer which comprises said irreversible thermosensitive coloring composition, which can be overlaid on or beside said reversible thermosensitive coloring recording layer.

8. The reversible thermosensitive coloring recording medium as claimed in claim 2, wherein said reversible thermosensitive coloring composition comprises an electron-donor coloring compound and an electron-acceptor compound, capable of reacting with said electron-donor coloring compound to induce color formation in said electron-donor coloring compound in said reversible thermosensitive coloring composition at the eutectic temperature thereof with the application of heat thereto.

9. The reversible thermosensitive coloring recording medium as claimed in claim 1, wherein the coloring composition in each of said reversible thermosensitive coloring composition layers is microcapsuled so as to be independently present in said reversible thermosensitive coloring recording layer.

* * * * *

UNITED STATES PATENT AND TRADEMARK OFFICE

CERTIFICATE OF CORRECTION

PATENT NO. : 5,585,320
DATED : DECEMBER 17, 1996
INVENTOR(S) : KYOJI TSUTSUI, ET AL.

It is certified that error appears in the above-identified patent and that said Letters Patent is hereby corrected as shown below:

Column 15, line 24, "developer, -hydroxycarboxylic"

should read --developer, α-hydroxycarboxylic--.

Column 24, line 45, "can be add"

should read --can be added--.

Column 26, lines 44-45, "erasure, even when image formation and erasure, even when image formation and erasure are"

should read --erasure, even when image formation and erasure are--.

Column 29, line 60, "an display"

should read --a display--.

Column 33, Table 4, second column, second occurrence, delete "black".

UNITED STATES PATENT AND TRADEMARK OFFICE

CERTIFICATE OF CORRECTION

PATENT NO. : 5,585,320
DATED : DECEMBER 17, 1996
INVENTOR(S) : KYOJI TSUTSUI, ET AL.

It is certified that error appears in the above-identified patent and that said Letters Patent is hereby corrected as shown below:

Column 35, line 32, "coloring coloring"

should read --coloring--.

Column 42, line 40, "coloring coloring"

should read --coloring--.

Column 48, line 30, "EXAMPLE 6"

should read --EXAMPLE 16--.

Signed and Sealed this

Twenty-seventh Day of October, 1998

*Attest:*

Bruce Lehman

BRUCE LEHMAN

*Attesting Officer*

*Commissioner of Patents and Trademarks*